US006426180B1

(12) United States Patent
Bringley et al.

(10) Patent No.: US 6,426,180 B1
(45) Date of Patent: Jul. 30, 2002

(54) COLOR PHOTOGRAPHIC ELEMENT CONTAINING SPEED IMPROVING COMPOUND IN COMBINATION WITH ELECTRON TRANSFER AGENT RELEASING COMPOUND

(75) Inventors: Joseph F. Bringley; James A. Friday, both of Rochester; Stephen P. Singer, Spencerport; Marcello Vitale, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/690,569

(22) Filed: Oct. 17, 2000

(51) Int. Cl.[7] ..... G03C 1/06

(52) U.S. Cl. ..... 430/614; 430/615; 430/505; 430/507; 430/510; 430/955

(58) Field of Search ..... 430/505, 614, 430/615, 507, 510, 955

(56) References Cited

U.S. PATENT DOCUMENTS

| | | | | |
|---|---|---|---|---|
| 3,989,527 A | | 11/1976 | Locker | |
| 4,859,578 A | | 8/1989 | Michno et al. | |
| 4,912,025 A | | 3/1990 | Platt et al. | |
| 5,994,042 A | | 11/1999 | Bringley et al. | |
| 5,994,043 A | | 11/1999 | Bringley et al. | |
| 5,998,113 A | | 12/1999 | Bringley et al. | |
| 5,998,114 A | | 12/1999 | Bringley et al. | |
| 5,998,115 A | | 12/1999 | Bringley et al. | |
| 6,001,548 A | | 12/1999 | Bringley et al. | |
| 6,110,657 A | * | 8/2000 | Lunt et al. | 430/955 |
| 6,114,103 A | * | 9/2000 | Friday et al. | 430/955 |
| 6,140,029 A | * | 10/2000 | Clark et al. | 430/614 |

FOREIGN PATENT DOCUMENTS

| | | |
|---|---|---|
| EP | 1 016 902 A2 | 7/2000 |
| EP | 1 016 912 A2 | 7/2000 |

* cited by examiner

*Primary Examiner*—Geraldine Letscher
(74) *Attorney, Agent, or Firm*—Arthur E. Kluegel

(57) ABSTRACT

Disclosed is a color silver halide photographic element comprising a support bearing:

(1) a light sensitive silver halide emulsion layer;

(2) a nitrogen heterocycle with a minimum of three heteroatoms that does not react with oxidized developer, does not contain free thiol substituents, and has a C log P sufficient to increase the photographic speed of said element compared to the same element without the compound, said heterocycle compound located either in said light sensitive layer or in a layer adjacent to it; and (3) an ETARC, in or adjacent to said light sensitive silver halide emulsion layer, that releases, upon reaction with oxidized developer, an electron transfer agent having a C log P of at least 2.40. The invention provides improved light sensitivity.

23 Claims, No Drawings

COLOR PHOTOGRAPHIC ELEMENT CONTAINING SPEED IMPROVING COMPOUND IN COMBINATION WITH ELECTRON TRANSFER AGENT RELEASING COMPOUND

CROSS REFERENCE TO RELATED APPLICATIONS

Co-filed herewith is an application Ser. No. 09/690,310 directed to a light sensitive color photographic element containing a speed improving nitrogen heterocycle with at least 3 heteroatoms and a reflector layer and an application Ser. No. 09/690,230 directed to a an element containing a certain reflector layer.

FIELD OF THE INVENTION

This invention relates to a light sensitive color photographic element containing a speed improving nitrogen heterocycle with at least 3 heteroatoms and an electron transfer agent releasing compound (ETARC).

BACKGROUND OF THE INVENTION

It is a long-standing objective of color photographic origination materials to maximize the overall response to light while maintaining the lowest possible granularity. Increased photographic sensitivity to light (commonly referred to as photographic speed) allows for improved images captured under low light conditions or improved details in the shadowed regions of the image. Sensitivity is much more important with origination materials than with print materials, the latter depending entirely on operator supplied light. In general, the overall light sensitivity provided by the light sensitive silver halide emulsions is a function of the size of the emulsion grains. Larger emulsion grains capture more light. Upon development, the captured light is ultimately converted into dye deposits that constitute the reproduced image. Undesirably, the granularity exhibited by these dye deposits is directly proportional to the grain size of the silver halide emulsion. Thus, larger silver halide emulsion grains have higher sensitivity to light but also lead to higher granularity in the reproduced image. Therefore, it is a fundamental problem in photography to improve the light sensitivity of a silver halide element without a corresponding decrease in another property such as granularity. In this description, it will be understood that the demonstrated increase in sensitivity is accomplished without a significant sacrifice in granularity. Stated from another perspective, it has been a long-standing problem to provide materials which maximize the response to light of a silver halide emulsion for any given grain size. It is highly desirable to provide non-imaging materials that lead to increased photographic speed without having to increase the size of the light-sensitive silver halide grains.

European application EP 1016902 describes the use of certain compounds, including heterocycles with a C log P of 6.2 or greater, in a light sensitive silver halide emulsion layer or in an adjacent non-light sensitive layer to increase the overall light sensitivity of a photographic element.

U.S. Pat. No. 3,989,527 discloses a method of increasing photographic speed whereby a light insensitive reflecting emulsion having a particle size from 0.40–0.60 $\mu$m is blended within a sensitized emulsion. U.S. Pat. Nos. 5,994,042, 5,994,043, 5,998,113, 5,998,114, 6,001,548 and 5,998,115 all describe the use of non-light sensitive light scattering or reflecting emulsions, or a combination thereof, to increase photographic speed.

Electron Transfer Agent Releasing Compounds (ETARCs) are taught in U.S. Pat. Nos. 4,859,578 and 4,912,025 and their use with Soluble Mercaptan Releasing Couplers (SMRCs) is taught in copending U.S. Ser. No. 09/224,230. ETARCs can improve the developability of silver halide emulsions which in some cases, offers improvements in light sensitivity.

Thus it is known to incorporate various materials such as those that cause light reflecting, and certain heterocyclic compounds or ETARCs to improve the light sensitivity of photographic elements. A problem to be solved is to provide color photographic elements that exhibit still further improved photographic speed.

SUMMARY OF THE INVENTION

The invention provides a color silver halide photographic element comprising a support bearing:

(1) a light sensitive silver halide emulsion layer;

(2) a nitrogen heterocycle with a minimum of three heteroatoms that does not react with oxidized developer, does not contain free thiol substituents, and has a C log P sufficient to increase the photographic speed of said element compared to the same element without the compound, said heterocycle compound located either in said light sensitive layer or in a layer adjacent to it; and (3) an ETARC, in or adjacent to said light sensitive silver halide emulsion layer, that releases, upon reaction with oxidized developer, an electron transfer agent having a C log P of at least 2.40. The invention also provides an imaging process.

The invention provides color photographic elements that exhibit a desirable increase in photographic speed.

DETAILED DESCRIPTION OF THE INVENTION

The invention is generally as described above. Typically, the color photographic element useful in the present invention contains at least one red sensitive silver halide emulsion layer with at least one non-diffusing cyan coupler, at least one green sensitive silver halide emulsion layer with at least one non-diffusing magenta coupler and at least one blue sensitive silver halide emulsion layer with at least one non-diffusing yellow coupler. The inventive elements are characterized in that there is associated with at least one of the light sensitive layers a nitrogen heterocycle with a minimum of three heteroatoms that does not react with oxidized developer, does not contain free thiol substituents, and has a C log P sufficient to increase the photographic speed of the element compared to the same element without the compound. The heterocycle compound is located either in the light sensitive layer or in a layer adjacent to it. The light reflecting material is located in either said light sensitive layer or in a layer proximate to it, meaning sufficiently close so as to effect a super-additive speed improvement compared to the speed improvement that would be realized from the separate addition of the two materials. The addition of the nitrogen heterocycle compound to a location as described imparts improved speed to the light sensitive layer with which it is associated.

The term "proximate" is used herein to describe the degree of proximity between the location of the heterocycle and reflecting material that enables the desired super-additive speed effect. Typically, the average distance between the nearest edges of the two layers is not more than 10 $\mu$m. as measured in a dry film.

The term "heteroatom" as used herein encompasses any atom other than carbon or hydrogen and includes, for example, nitrogen, sulfur, phosphorous and oxygen. The term "heteroatom" refers only to those ring-member atoms which form an integral part of the ring system and not to those atoms that are located externally to the ring system or separated from it by at least one single, unconjugated bond or are part of an additional substituent of the ring system.

In various aspects of the invention, the heterocycle compound is a particular kind of nitrogen heterocycle with a minimum of three heteroatoms and includes examples such as a tetraazaindene, a benzotriazole, a triazole, a tetrazole, a thiadiazole and an oxadiazole.

The heterocyclic compounds useful in the invention, or "speed compounds", are similar to compounds known to cause inhibition of silver development, but, because of their increased hydrophobicity (as measured by a higher C log P), they do not cause inhibition of silver development per se. Among the classes of compounds that contain a minimum of three heteroatoms and are known to cause inhibition of silver development that can be included in the invention when appropriately substituted to increase hydrophobicity are: triazoles, oxadiazoles, thiadiazoles, oxathiazoles, thiatriazoles, benzotriazoles, tetrazoles, benzisodiazoles and purines and other polyazaindenes. Formulations useful for the purpose of the invention, namely an increase in photographic speed, have the desired overall hydrophobicity (as measured by C log P), do not contain a free thiol substituent. The minimum C log P for speed improvement may vary somewhat for each class of compound useful in this invention, but it has been found that, at the C log P useful for increasing speed, the silver development inhibiting effect does not occur to any significant extent.

One class of nitrogen heterocycles useful in the invention is polycyclic nitrogen heterocycles, such as those that contain at least two ring systems composed only of carbon and at least three nitrogen atoms. Specific examples of useful polycyclic nitrogen heterocycles with at least three nitrogen atoms as part of the ring system are benzotriazoles and tetraazaindenes (including purines). Another useful class of heterocycles are the monocyclic heterocycles comprising carbon and at least two nitrogen atoms with at most only one ring sulfur or ring oxygen atom. Specific classes of these heterocycles are triazoles, oxadiazoles, thiadiazoles and tetrazoles.

The substituents located directly on the heterocycles can be hydrogen or any group chosen such that together the entire compound meets the overall C log P requirement but may not include free thiol (—SH) groups or their equivalents. Heterocycles that meet all the requirements but also contain free thiol groups do not demonstrate the desired synergistic speed effects when combined with the light-reflecting materials useful in the invention. It should be noted that nitrogen heterocycles substituted with —SH groups can often be written in alternative equivalent tautomeric forms as thiocarbonyl groups where the hydrogen is located on one of the ring nitrogens; these forms are chemically equivalent to the —SH forms and are excluded from the invention. Suitable substituents may be groups such as alkyl, aryl, alkoxy, aryloxy, alkylthio, arylthio, sulfoxyl, sulfonyl, sulfamoyl

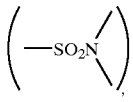

halo such as fluoro, chloro, bromo or iodo, cyano, hydroxy, nitro, —O—CO—, —O—$SO_2$—, heterocyclic such as furanyl or morpholino, carbonyl such as keto, carboxylic acid (—$CO_2$H), carboxylate ester (—$CO_2$—), carbamoyl

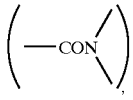

amino such as a primary, secondary or tertiary substituted nitrogen, carbonamido (>NCO—), and sulfonamido (>$NSO_2$—). A substituent may also connect two or more independent nitrogen heterocycle nuclei together so long as the entire molecule still meets the C log P limitations. In addition, the substituent may further contain a group that can be incorporated into a polymeric backbone so long as the monomeric species meets the C log P limitations. It should be noted wherever it is possible to write alternative tautomeric structures of the heterocyclic nucleus, these are considered to be chemically equivalent and are part of the invention.

Forms of the polycyclic nitrogen heterocycles useful in the invention contain a 6/6 or 6/5 two-ring bicyclic nucleus in which the two rings contain at least 4 nitrogen atoms over both ring systems so long as no three nitrogen atoms are consecutive, that is, directly connected to each other, unless one of the three consecutive nitrogens occupies a bridgehead position or all three nitrogens are located in the same six membered ring. Any particular nitrogen atom may be part of only one ring or be located in a bridgehead position. A bridgehead position is where an atom forms part of more than one ring. In addition, it is possible that other ring systems may be annulated to these heterocyclic ring systems or even be located between these rings so long as two rings (at least one of which must be a six membered ring) contain, between them, at least 4 nitrogen atoms and do not contain 3 nitrogen atoms directly connected to each other unless one of the three nitrogens occupies a bridgehead position or all three nitrogens are located in the same six membered ring. The additional rings may or may not contain additional nitrogen atoms or other heteroatoms such as sulfur or oxygen. None of the rings that comprise the heterocyclic nucleus are isolated or joined only by a single bond. It is preferred that the heterocyclic nucleus be aromatic or pseudo-aromatic. Another useful form of polycyclic nitrogen heterocycle is benzotriazole, which contains only 3 nitrogen atoms, that are connected to each other and none of which occupies a bridgehead position.

A particularly preferred form of the heterocycle useful in the invention is a 6/5 bicyclic aromatic nitrogen heterocycle that contains at least 4 nitrogen atoms as part of the ring system and does not contain 3 nitrogen atoms directly connected to each other unless one of the three nitrogen atoms occupies a bridgehead position or all three nitrogen atoms are located in the same six membered ring and is substituted so that the overall C log P for the compound is at least 6.2. Typically, the C log P is at least 6.8 or suitably at least 7.2. It is also desired that the C log P be equal to or less than 13.0, conveniently less than or equal to 11.5.

Some examples of the 6/5 bicyclic heterocycle compounds useful in the invention are the following tetraazaindenes and pentaazaindenes (numbered according to the structure below): 1,3,4,6 and 1,3,5,7 (both also known as purines); 1,3,5,6; 1,2,3a,4; 1,2,3a,5; 1,2,3a,6; 1,2,3a,7; 1,3,3a,7; 1,2,4,6; 1,2,4,7; 1,2,5,6 and 1,2,5,7. These compounds may also be described as derivatives of imidazo, pyrazolo- or triazolo-pyrimidines, pyridazines or pyrazines. Some examples of pentaazaindenes are 1,2,3a,4,7; 1,2,3a,5,7 and 1,3,3a,5,7. An example of a hexaazaindene would be 1,2,3a,4,6,7.

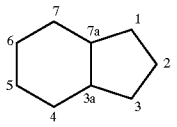

Desirable examples are those in which the 6/5 bicyclic nitrogen heterocycle are 1,3,4,6; 1,2,5,7; 1,2,4,6; 1,2,3a,7 or 1,3,3a,7-tetraazaindene derivatives.

For these types of polycyclic nitrogen heterocycles, it is possible that ionizable substituents, such as hydroxy (—OH) or non-tertiary amino groups (—$NH_2$ or —NH—) could be attached to a ring atom such that conjugation to a ring nitrogen can occur to provide tautomeric forms of the heterocycle. It is preferred to have none of this kind of substituent, unless there is a bridgehead nitrogen in which case it is preferred to have at most only one hydroxy or amino group, to maintain the desired degree of silver interaction.

The embodiment of a purine derivative is represented by Formula I:

I

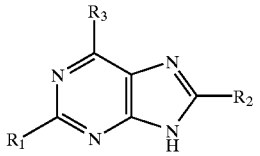

wherein $R_1$ and $R_2$ are each independently hydrogen or a group such as an alkyl, aryl, alkoxy, aryloxy, alkylthio, arylthio, sulfoxyl, sulfonyl, sulfamoyl, halo such as fluoro, chloro, bromo, and iodo, cyano, nitro, —O—CO—, —O—$SO_2$—, heterocyclic, carbonyl such as keto, carboxylic acid, carboxylate ester, carbamoyl, amino such as a primary, secondary or tertiary substituted nitrogen, carbonamido, or sulfonamido group. $R_3$ is an alkyl, aryl, alkoxy, aryloxy, alkylthio, arylthio, sulfonyl, sulfoxyl, secondary or tertiary amino, carbonamido, or sulfonamido group, all of which may be substituted as provided hereinafter. Compounds in which $R_3$ is an alkoxy or alkylthio group are especially useful. The overall C log P should be at least 6.2, or more suitably, at least 6.8 or at least 7.2, with a maximum C log P equal to or less than 13.0.

Embodiments of a 1,2,5,7-tetraazaindene derivative are according to Formula IIa or a 1,2,4,6-tetraazaindene derivative are according to Formula IIb:

IIa

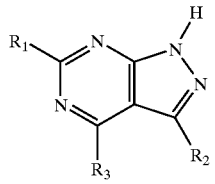

IIb

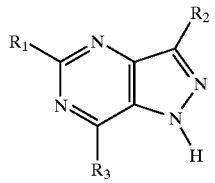

wherein $R_1$, $R_2$ and $R_3$ are each as defined above. Compounds in which $R_3$ is an alkoxy or alkylthio group are especially useful. The overall C log P should be at least 6.2, or suitably at least 6.8 or at least 7.2 with a maximum C log P equal to or less than 13.0.

Examples of a 1,2,3a,7-tetraazaindene derivative are represented by Formula III:

III

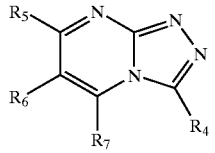

wherein $R_4$, $R_5$, $R_6$ and $R_7$ are each as defined for $R_1$ and $R_2$ above but also including hydroxy groups. Especially useful are compounds where $R_7$ is a hydroxy group, $R_5$ is an alkyl group and $R_4$ is the same as defined for $R_3$ with alkyl, aryl, alkoxy, arylthio, or alkylthio groups being desirable. The overall C log P should be at least 6.2, or suitably at least 6.8 or at least 7.2, with a maximum C log P equal to or less than 13.0.

Embodiments of a 1,3,3a,7-tetraazaindene derivative are represented by Formula IV:

IV

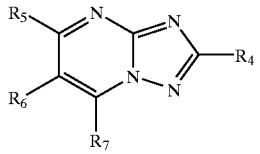

wherein $R_4$, $R_5$, $R_6$ and $R_7$ are the same as for Formula III. Especially useful are compounds where $R_7$ is a hydroxy group, $R_5$ is an alkyl group and $R_4$ is the same as defined for $R_3$ with alkoxy or alkylthio groups being desirable. The overall C log P should be at least 6.2, or suitably at least 6.8 or at least 7.2, with a maximum C log P equal to or less than 13.0.

Another form of the heterocycle useful in the invention is a benzotriazole in which the overall C log P for the compound is at least 7.8, suitably at least 8.2 or at least 9.0. It is also desired that the C log P be equal to or less than 13.0. Benzotriazole examples are represented by Formula V wherein $R_8$, $R_9$, $R_{10}$ and $R_{11}$ are each individually defined as for $R_1$ and $R_2$ above. Embodiments of a benzotriazole derivative are where $R_8$ and $R_{11}$ are hydrogen and where $R_9$ is a carboxylate ester, carbamoyl, carbonamido, sulfonamido, alkoxy or an aryloxy group.

V

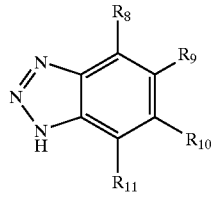

Another embodiment of the nitrogen heterocycle is a triazole in which the overall C log P for the compound is at least 8.75, suitably at least 9.0 or at least 9.25 and equal to or less than 13.0. Embodiments of a triazole are 1,2,3-triazoles according to Formula VI and 1,2,4-triazoles according to Formula VII wherein $R_{12}$ and $R_{13}$ are each individually defined as for $R_1$ and $R_2$ above. Embodiments of triazoles are where $R_{12}$ is hydrogen, or an alkyl or aryl group and $R_{13}$ is an alkylthio, arylthio, carboxylate ester, or alkyl group.

VI

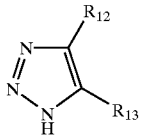

VII

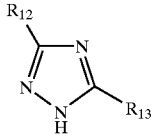

Another form of the nitrogen heterocycle useful in the invention is a diazole in which the overall C log P for the compound is at least 7.6, suitably at least 7.9 or at least 8.2 and equal to or less than 11.5. Embodiments of a diazole are according to Formula VIII wherein X is oxygen or sulfur and $R_{14}$ and $R_{15}$ are each individually defined as for $R_1$ and $R_2$. The most preferred examples of an oxadiazole or a thiadiazole are where $R_{14}$ is an alkylthio or arylthio group and $R_{15}$ is an alkyl, aryl, alkylthio, arylthio or amino group.

VIII

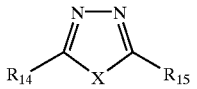

Another embodiment of the nitrogen heterocycle useful in the invention is a tetrazole. Embodiments of a tetrazole are represented by Formula IX wherein $R_{16}$ and $R_{17}$ are as defined for $R_1$. Embodiments of a tetrazole are when $R_{16}$ is an alkylthio or arylthio group and $R_{17}$ is an alkyl, aryl or heterocyclic group; or when $R_{17}$ is hydrogen and $R_{16}$ is an alkyl, aryl, amino, alkoxy or aryloxy, heterocyclic, alkylthio, or arylthio group. The C log P for the compound should be at least 6.5 suitable at least 7.0 or at least 7.5 and should be less than or equal to 13.

IX

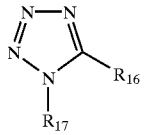

The compounds useful in the invention are not couplers and do not react with oxidized developer (Dox) to generate dyes or any other product. It is desired that the compounds useful in the invention do not undergo any significant amounts (less than 5–10%) of chemical or redox reaction directly with oxidized color developer. They are colorless. They are stable to other components of the processing solutions and do not contain substituents that undergo substantial amounts of chemical reaction in any of the processing solutions (except when the compound has a suitable NH or OH bond replaced by a temporary blocking group that is removed in a non-imagewise fashion as detailed below). For example, the inventive materials do not contain hydrazino or hydroquinone groups that may cross-oxidize during silver development nor are they covalently linked to any other kind of photographic useful group (PUG). However, the inventive materials may contain, for example, ester substituents that are not substantially hydrolyzed (less than 5–10%) during the development process. The compounds useful in the invention are located in the film element as described and are not added to the processing solutions.

An important feature of the compounds useful in the invention is their hydrophobicity which is related to their octanol/water partition coefficient (log P). In order to maximize the photographic effect, the partitioning into water cannot be so low that the material is unable to reach the surface of the emulsion grains. It has also been found that the partitioning into water cannot be too high. Because it can be difficult to measure log P values above 3, a model can be used to compute an estimate of log P, called C log P that defines the limits of the invention. The model used is MEDCHEM Version 3.54, which is a software program produced by the Medicinal Chemistry Project at Pomona College in California.

One way to enter a structure into the MEDCHEM program in order to calculate a C log P is through a SMILES string. The way to enter the SMILES string for a nitrogen compound is to enter all non-hydrogen atoms as capitals and let the MEDCHEM program determine the appropriate aromaticity. An example is shown for compound A below: CCCCCCCCCCCCCCOC1=C2N=CNC2=NC=N1. This entry gives the value 6.91. When the entry is in this form, the heterocyclic N—H will be drawn in the structure by the MEDCHEM program. If the entry is not in this form, the MEDCHEM program will not display the heterocyclic N—H group and the resulting C log P value is incorrect. Structures such as A and AJ can be drawn in multiple tautomeric forms, for example, hydrogens on different ring atoms, enol or keto tautomeric forms (or thiol or thione forms for sulfur compounds). If C log P values can be calculated for more than one tautomeric form of a single compound and at least one of those values is within the specified range for that class, then the compound is within the scope of those useful in the invention. Some tautomers may not compute in MEDCHEM 3.54, because there is a fragment in the molecule that is missing in the MEDCHEM database. In such a case, log P of the nucleus of the molecule (with appropriate aromatic or aliphatic substituents) must be experimentally measured and the missing fragment value must be entered into the algorithm manager of MEDCHEM as instructed by the manual.

For the purposes of this invention, the C log P refers to neutral molecules, even if they would be ionized or protonated (either fully or in part) at the processing pH or at the ambient pH of the photographic film. Thus, in practice, it is usually desirable that the substituents of the compound useful in the invention do not contain additional very low $pK_a$ (<7) groups such as sulfonic or carboxylic acids nor very basic groups (pKa of conjugate acid <10) such as a tertiary amino group (unless such an amino group is attached to a heterocylic ring such that it is conjugated to a nitrogen atom, in which case its basicity is greatly reduced) since they require an increase in the size and amount in the rest of the hydrophobic substituents in order to meet the overall C log P requirements.

There is a specific range of C log P for each class of compounds, depending on its particular nature, which should not be exceeded. For most examples, it is preferred that the C log P not exceed 13.0 or more preferably for some types of compounds, that it not exceed 11.5. When the compound has a C log P equal to or greater than some minimum value to show the desired speed effect silver inhibition does not occur. For most examples, the C log P should not be lower than 6.2 and it is usually preferred that the C log P of the compound be at least 6.8 or greater or even 7.2 or greater.

One of the most important and novel characteristics of the compounds of this invention is the finely tuned balance between their hydrophobic and hydrophilic nature. The hydrophobic/hydrophilic nature of a compound can be estimated by calculation of its partition coefficient between octanol and water (C log P) using the MEDCHEM program as described above, and this has been used herein to define the range of values of C log P for each class of compound within which they exhibit the desired effect. The terms 'ballast' or 'ballasted' as generally applied in the photographic art are often applied only loosely and without quantification to imply a restriction of movement. The activity of the inventive compounds is therefore best defined in terms of their calculated C log P values.

For each compound useful in the invention, as the laydown is increased a threshold level is reached following which the speed improvement gradually increases with laydown, after which the improvement then levels off at a compound specific maximum level. It will be appreciated that the amount is also a function of other variables such as the location and number of layers in which the compound is located, the solvent used, and film dimensions. Thus, it is desirable to have enough laydown of the compound in order to obtain the speed improvement. Suitably, there is present sufficient laydown to achieve an improvement of at least 0.05, and desirably at least 0.10 and even 0.25 stops or more. Where the compound is present in a sensitized layer, the ratio of compound to silver is suitably at least 0.1 mmol of compound per mol of silver halide and, more preferably, at least 1.0 mmol of compound per mol of silver halide and, most preferably, at least 2.0 mmol per mol of silver halide. When coated in a non light-sensitive layer, the laydown of the compound is suitably at least $3\times10^{-5}$ mol/m$^2$ or suitably at least 0.0001 mol/m$^2$.

The following are examples of speed compounds, along with the corresponding C log P values, that are useful in this invention:

A

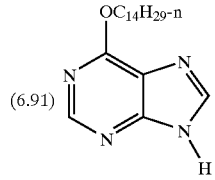

(6.91)

B

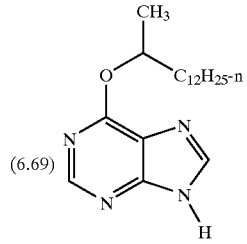

(6.69)

C

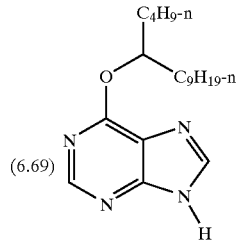

(6.69)

D

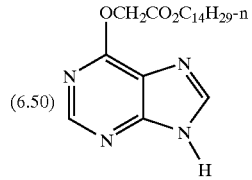

(6.50)

E

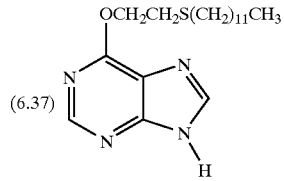

(6.37)

F

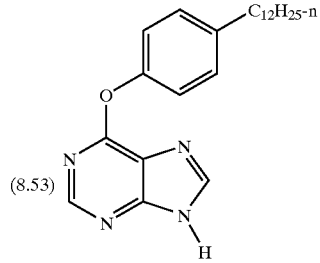

(8.53)

-continued
G
(7.21)
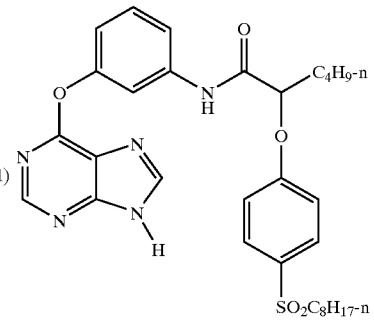
H
(6.65)
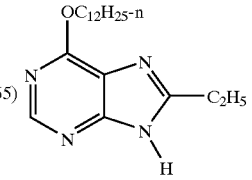
I
(6.92)
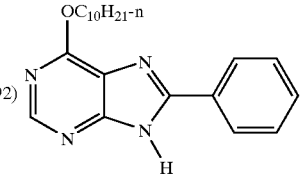
J
(8.32)
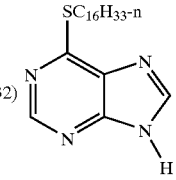
K
(6.76)
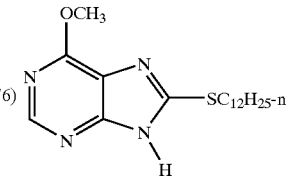
L
(7.78)
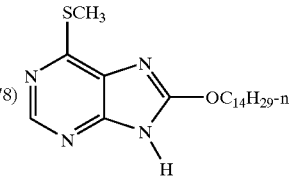
M
(7.00)
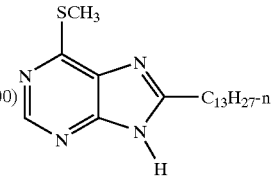
N
(6.27)
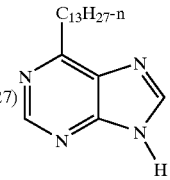
-continued
O
(7.19)
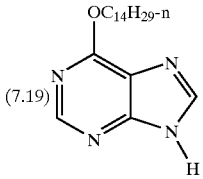
P
(7.47)
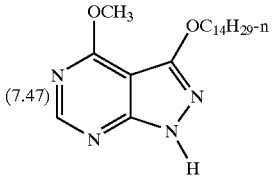
Q
(6.49)
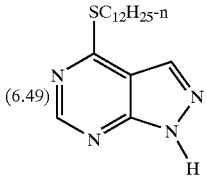
R
(7.27)
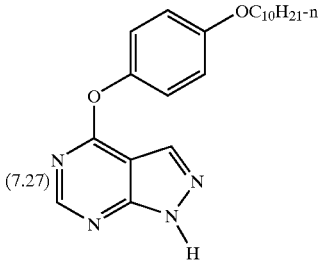
S
(7.09)
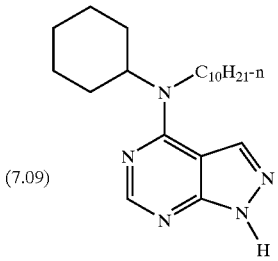
T
(8.30)
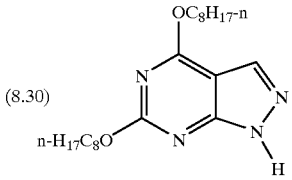
U
(7.45)
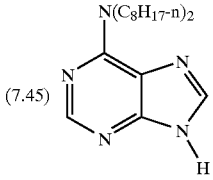

-continued
V
(7.33)
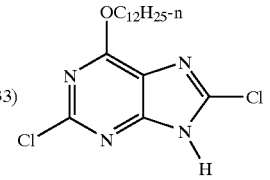
W
(7.43)
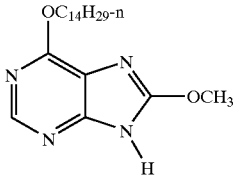
X
(7.78)
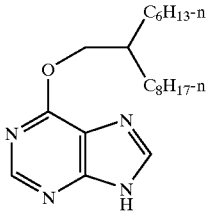
Y
(7.97)
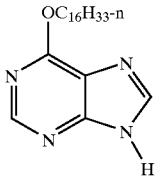
Z
(9.03)
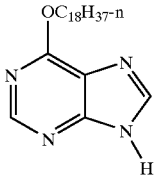
AA
(6.21)
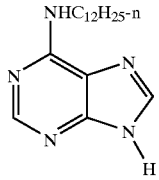
AB
(6.98)
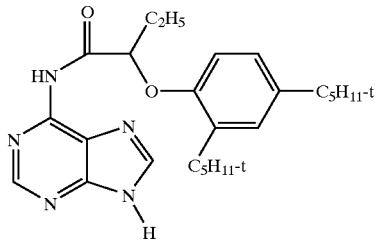
AC
(7.09)
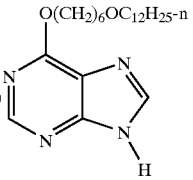
-continued
AD
(8.19)
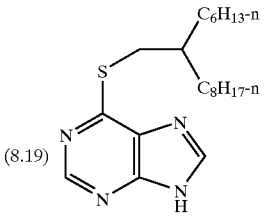
AE
(8.30)
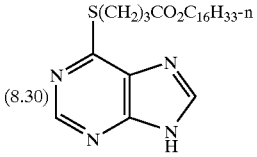
AF
(9.36)
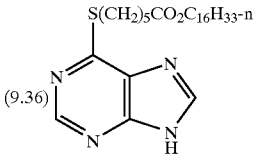
AG
(7.45)
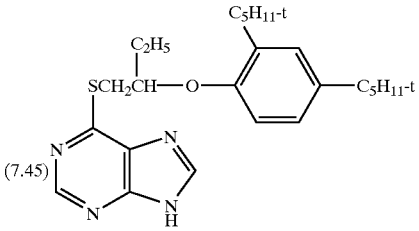
AH
(8.17)
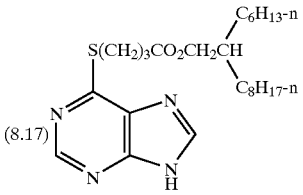
AI
(6.66)
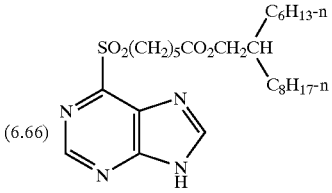
AJ
(9.35)
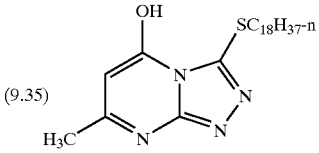
AK
(10.68)
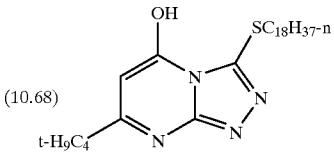

-continued
AL
(7.41)
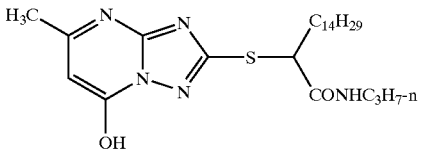
AM
(8.11)
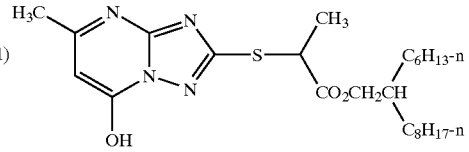
AN
(10.49)
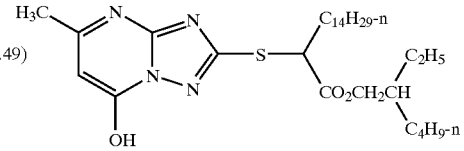
AO
(7.75)
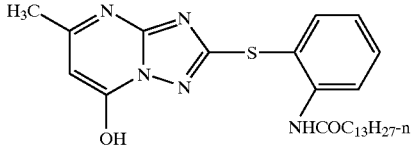
AP
(6.59)
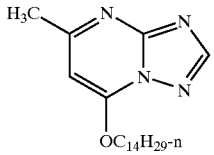
AQ
(7.52)
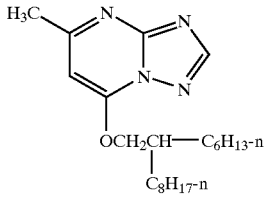
AR
(8.57)
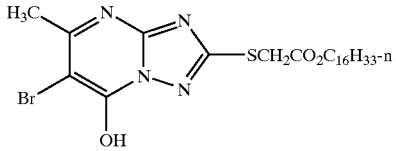
AS
(6.94)
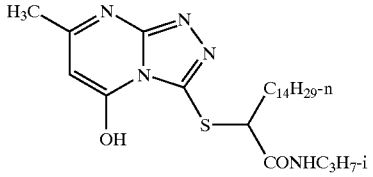
AT
(6.70)
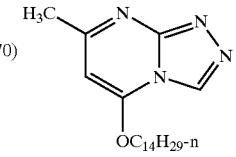
-continued
AU
(9.68)
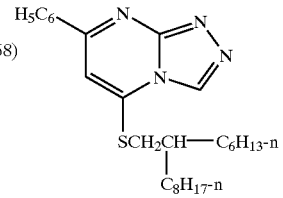
AV
(7.90)
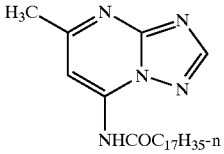
AW
(8.11)
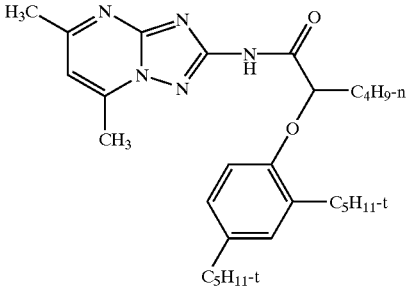
AX
(8.37)
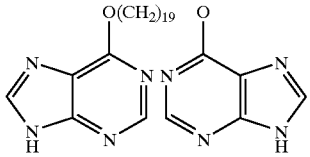
AY
(8.53)
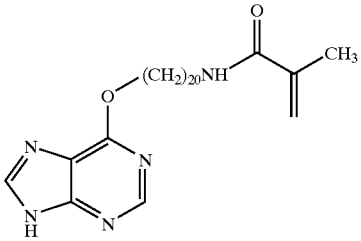
(2:1:1 by weight copolymer with styrene and n-butyl acrylate)
AZ
(11.08)
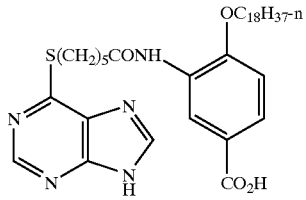
BA
(7.99)
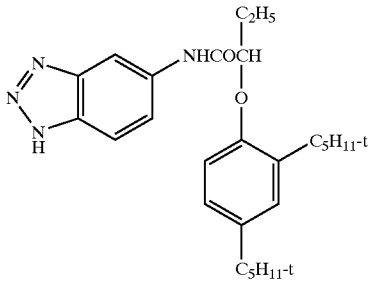

-continued

BB (8.94)

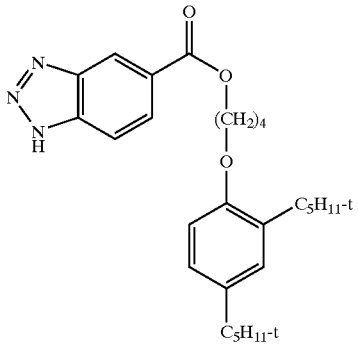

BC (9.04)

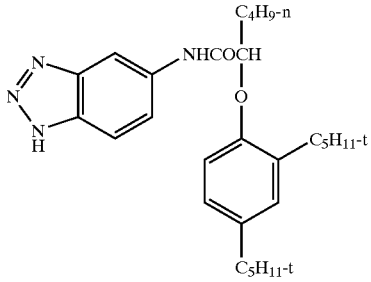

BD (10.10)

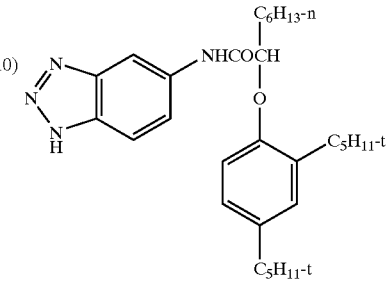

BE (11.18)

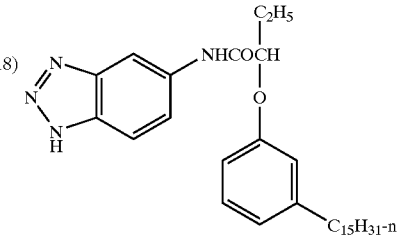

BF (10.66)

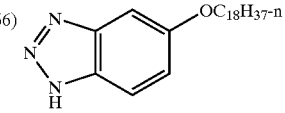

BG (8.44)

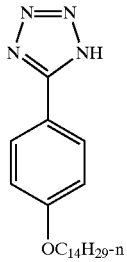

-continued

BH (12.07)

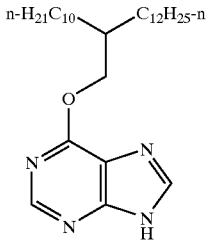

BI (10.23)

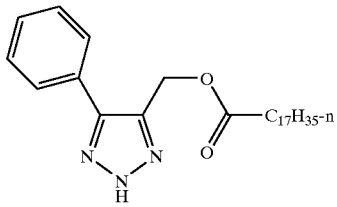

BJ (7.76)

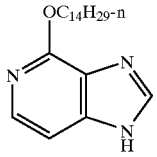

BK (6.7)

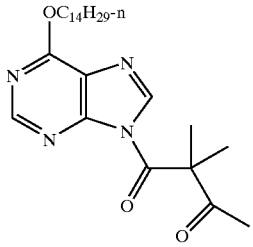

BL (7.84)

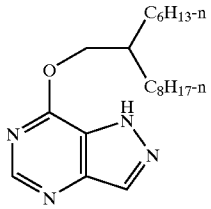

BM (10.23)

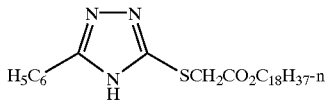

The speed compounds useful in the invention can be added to a gel pre-melt or a mixture containing silver halide before coating or, more suitably, be mixed with the silver halide just prior to or during coating. In either case, additional components like couplers, doctors, surfactants, hardeners and other materials that are typically present in such solutions may also be present at the same time. The speed compounds useful in the invention are not water-soluble and cannot be added directly to the solution. They may be added directly if dissolved in an organic water miscible solution such as methanol, acetone or the like or more preferably as a dispersion. A dispersion incorporates the speed compounds in a stable, finely divided state in a hydrophobic organic solvent (often referred to as a coupler solvent or permanent solvent) that is stabilized by suitable surfactants and surface active agents usually in combination with a binder or matrix such as gelatin. The dispersion may contain one or more permanent solvents that dissolve the compound and maintain it in a liquid state. Some examples of suitable permanent solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Permanent solvents can also be described in terms of physical constants such as alpha, beta and pi* as defined by M. J. Kamlet, J-L. M. Abboud, M. H. Abraham and R. W. Taft, J. Org Chem, 48, 2877(1983). The preferred permanent solvents used with the speed compounds are those with C log P of 5.0 or greater and beta values of 0.4 or greater or more preferably, beta values of 0.5 or greater. Useful classes of solvents are carbonamides, phosphates, alcohols and esters. When a solvent is present, it is typical that the weight ratio of compound to solvent be at least 1 to 0.5, or most preferably, at least 1 to 1. The dispersion may require an auxiliary coupler solvent initially to dissolve the component but this is removed afterwards, usually either by evaporation or by washing with additional water. Some examples of suitable auxiliary coupler solvents are ethyl acetate, cyclohexanone and 2-(2-butoxyethoxy) ethyl acetate. The dispersion may also be stabilized by addition of polymeric materials to form stable latexes. Examples of suitable polymers for this use generally contain water-solubilizing groups or have regions of high hydrophilicity. Some examples of suitable dispersing agents or surfactants are Alkanol XC or saponin. The speed compounds may also be dispersed as an admixture with another component of the system such as a coupler or an oxidized developer scavenger so that both are present in the same oil droplet. It is also possible to incorporate the compounds useful in the invention as a solid particle dispersion; that is, a slurry or suspension of finely ground (through mechanical means) compound. These solid particle dispersions may be additionally stabilized with surfactants and/or polymeric materials as known in the art. Also, additional permanent solvent may be added to the solid particle dispersion to help increase activity.

The sensitivity of the human eye is greatest to green light and so, the invention is most useful when affecting the green record (the layer whose maximum spectral sensitivity to light falls between 500 and 600 nm). The following are examples of magenta couplers useful in conjunction with the elements of the invention, either separately or combined:

M-1

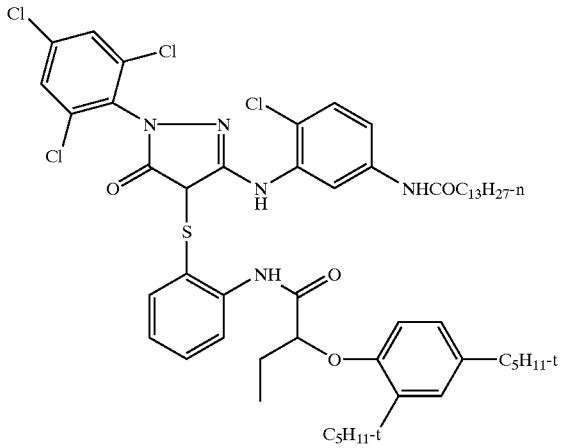

-continued

M-2

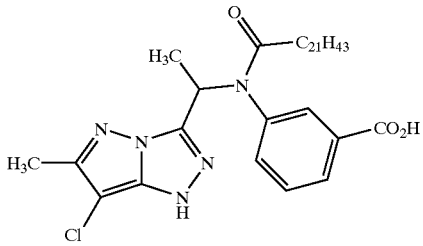

M-3

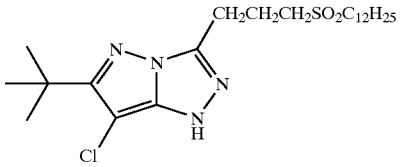

M-4

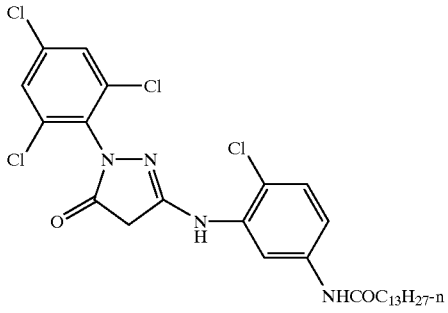

M-5

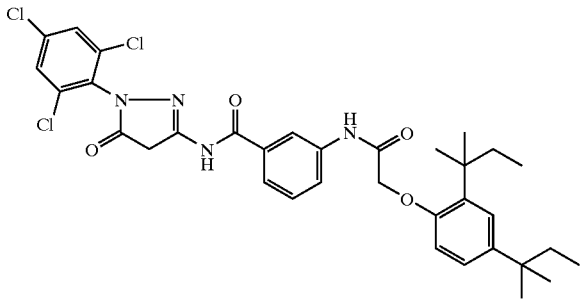

M-6

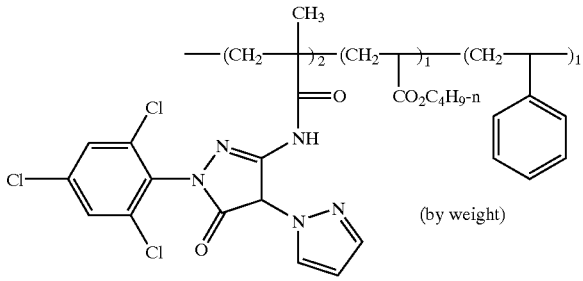

(by weight)

-continued
M-7
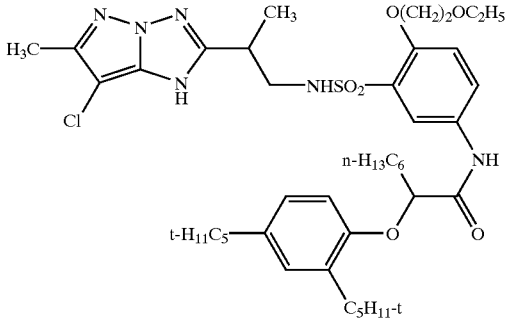
M-8
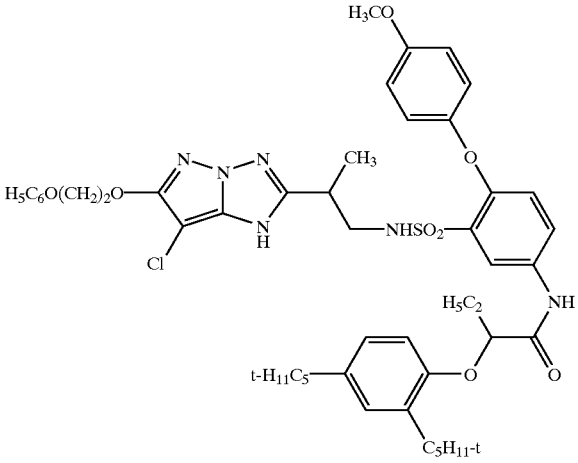
M-9
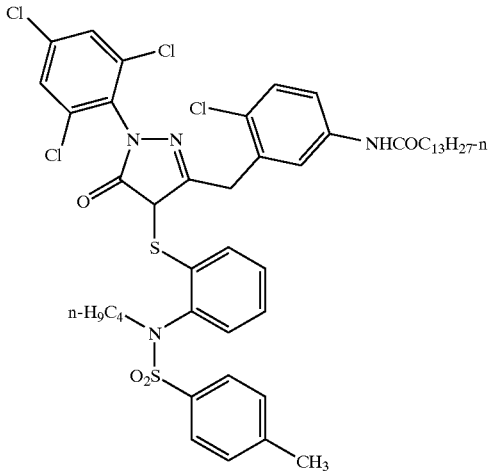
-continued
M-10
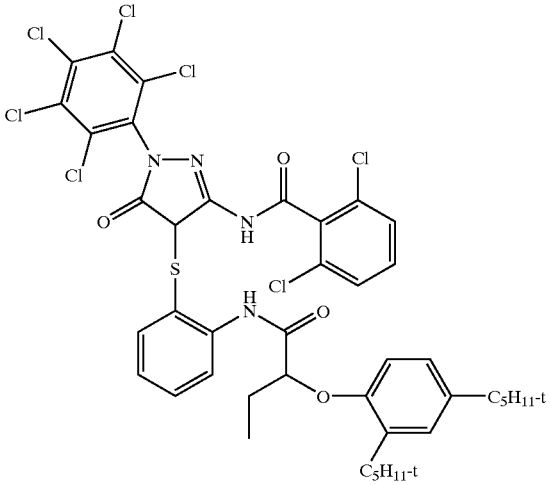
M-11
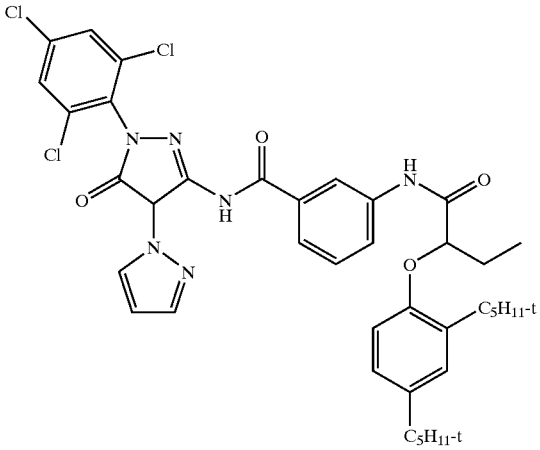
M-12
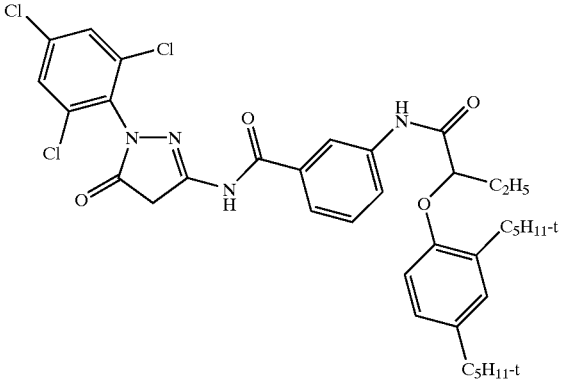

The following are examples of green sensitizing dyes useful in the elements of the invention either separately or combined:

GSD-1

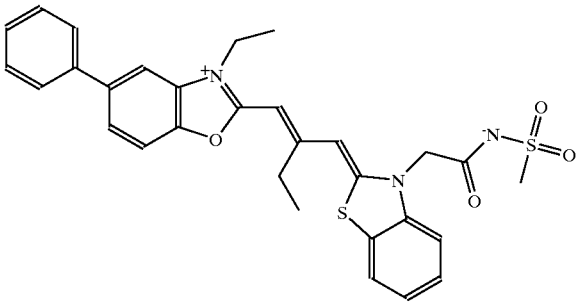

GSD-2

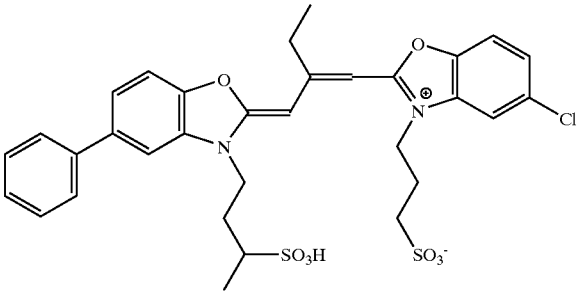

GSD-3

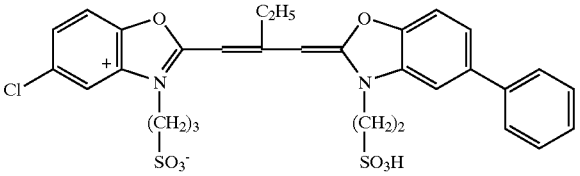

GSD-4

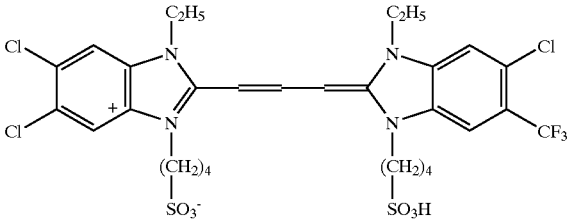

GSD-5

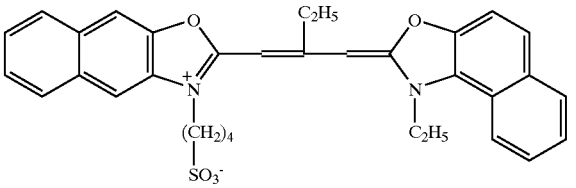

GSD-6

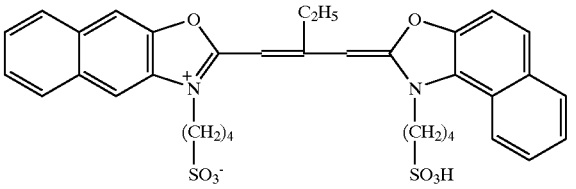

-continued

GSD-7

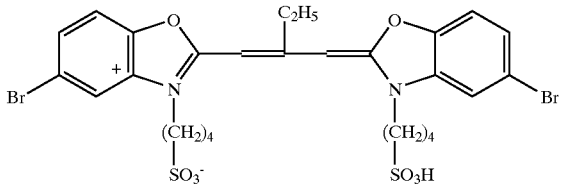

GSD-8

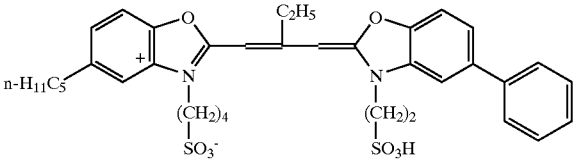

GSD-9

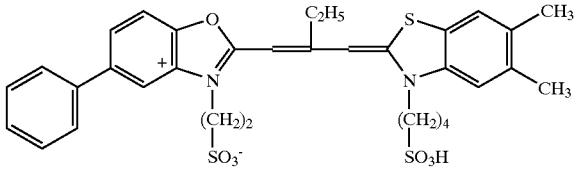

GSD-10

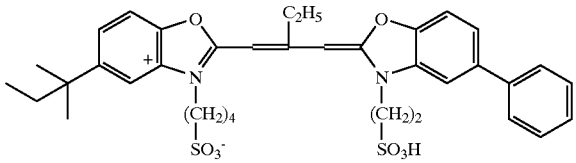

GSD-11

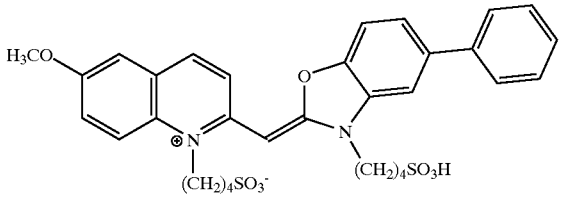

Red speed is a particular problem in many color negative origination elements, since the red-sensitive record, receiving light filtered through the overlying blue and green records, is the most light-challenged. The following cyan couplers are examples of couplers useful in elements of the invention, either separately or combined:

C-1

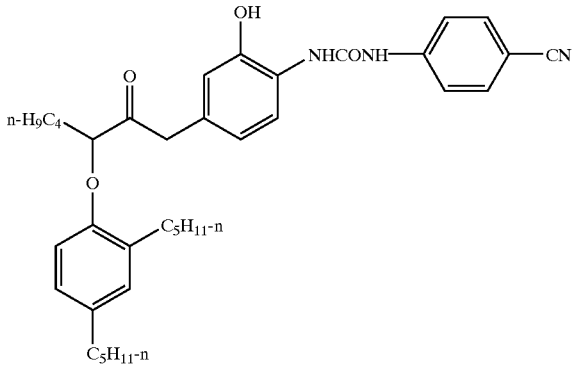

-continued
C-2
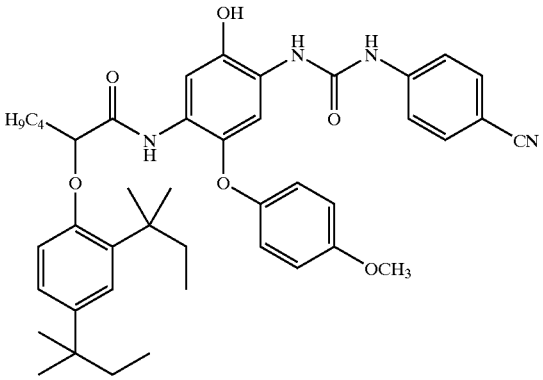
C-3
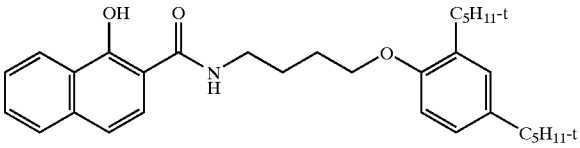
C-4
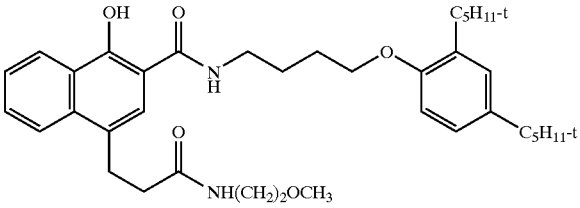
C-5
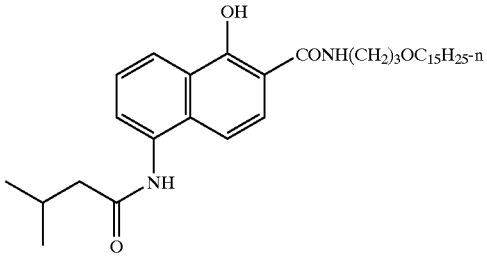
C-6
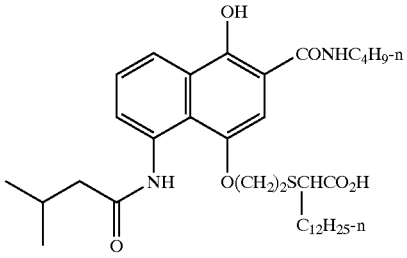
C-7
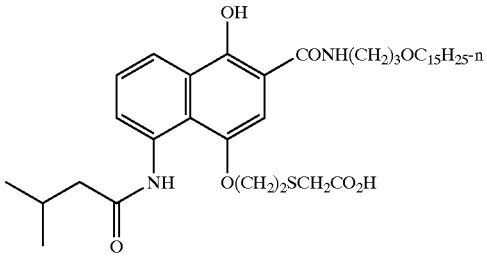
-continued
C-8
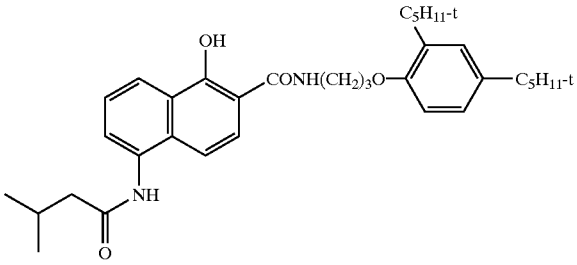
C-9
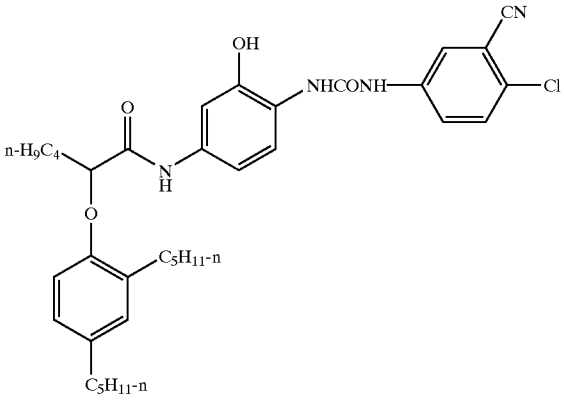
C-10
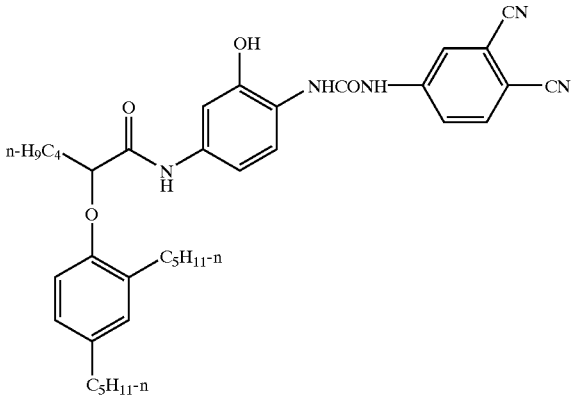
C-11
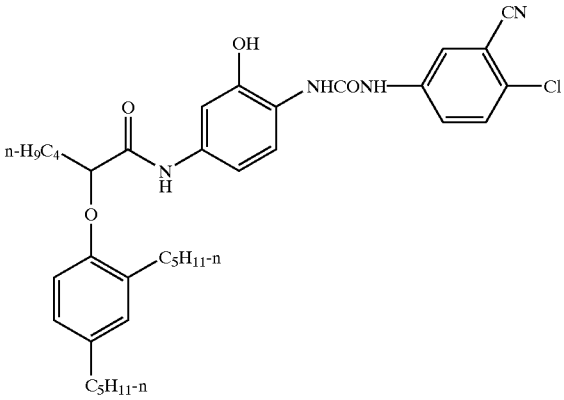

-continued
C-12
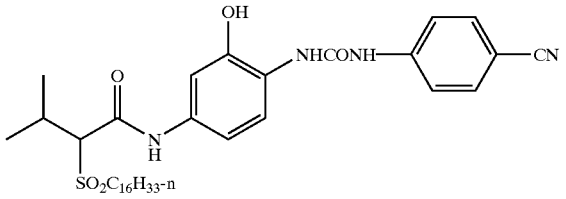
The following are examples of red sensitizing dyes useful in the elements of the invention, either separately or combined:
RSD-1
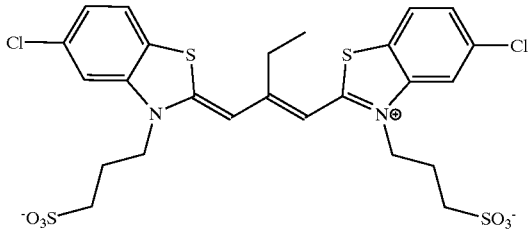
RSD-2
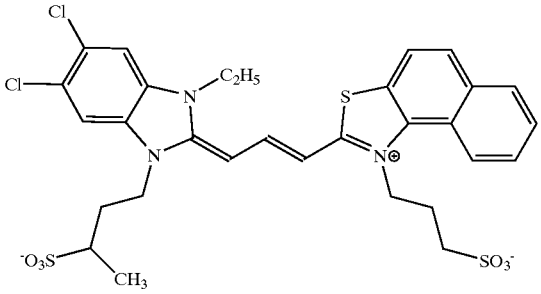
RSD-3
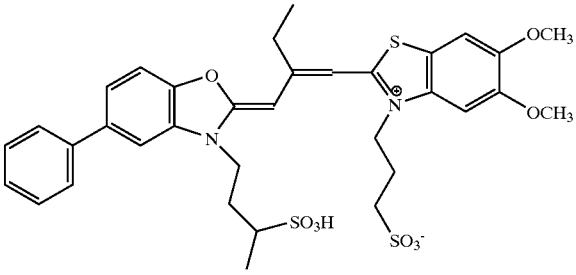
RSD-4
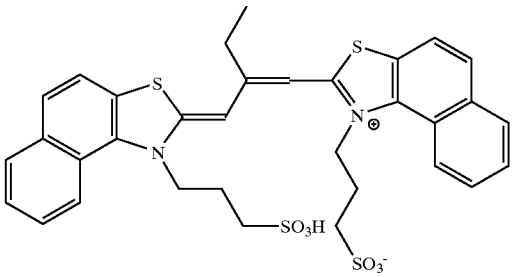
-continued
RSD-5
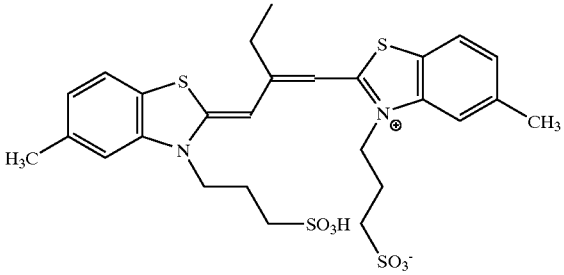
RSD-6
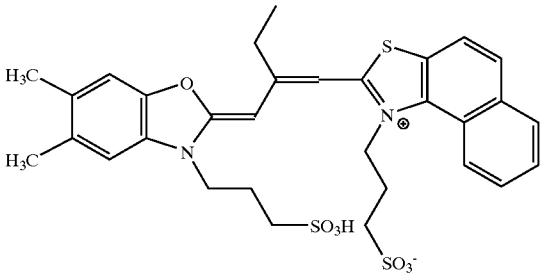
RSD-7
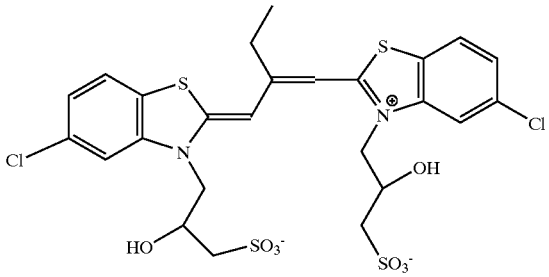
RSD-8
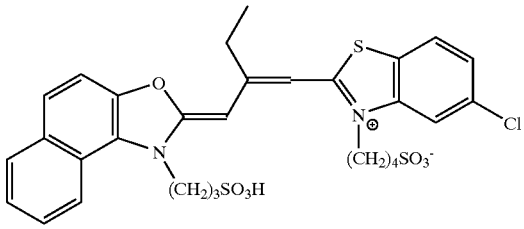
RSD-9
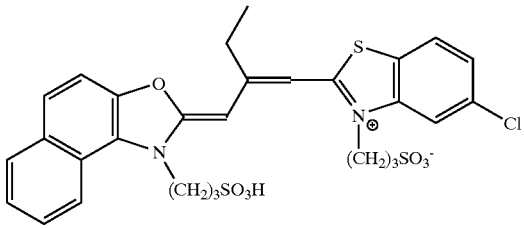

-continued

RSD-10

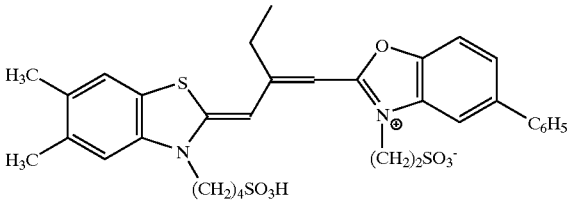

RSD-11

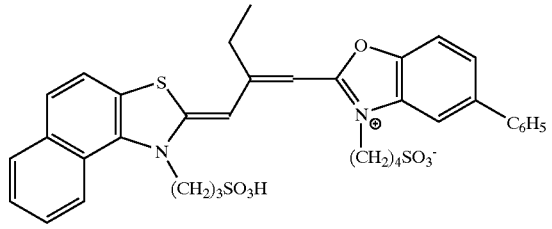

The type of light sensitive silver halide emulsion used in the imaging layer(s) affected by the invention may be important to obtain the desired increase in light sensitivity. The silver halide emulsion is suitably a silver iodobromide emulsion, meaning an emulsion that is low in chloride. By low in chloride, it is meant that there should be no more than 20 mol %. More suitably, there is present in the layer no more than 10 mol % chloride, and typically no more than 1 mol % chloride. The emulsion suitably contains at least 0.01 mol % iodide, or more preferably, at least 0.5 mol % iodide or most preferably, at least 1 mol % iodide. The benefit of the increase in light sensitivity is most apparent in combination with larger sized emulsions that are associated with increased granularity. Thus, it is preferred that the elements of the invention are used with imaging emulsions that have an equivalent circular diameter of at least 0.8 micrometer, or more preferably, at least 1.0 micrometer, or most preferably, at least 2.5 micrometer. In addition, the benefit of the invention is greatest in origination materials such as color negative or color reversal materials since they require higher sensitivity to light (because of the variable lighting conditions in natural scenes) and low granularity (due to high magnification) relative to color print materials for which exposure conditions are carefully controlled and which are viewed directly under low magnification conditions.

The invention is also particularly useful when applied to film elements that contain low overall silver levels. Thus, films containing 10 g/m$^2$ of total silver or less, or more preferably 5.4 g/m$^2$ or less or even 4.3 g/m$^2$ or less benefit from the use of the compounds useful in the invention.

The invention can be applied to affect one or more than one color record, that is records sensitive to a specific range of light wavelengths. Therefore, the invention can be applied to increase at the same time photographic speed in any combination of the red, green and blue color records, either by a single or a multiple application of the speed compound and/or the light reflecting material.

In order to control and maintain granularity over a wide exposure range, it is a common practice to divide an individual color record into separate layers, each containing silver halide emulsions of different degree of sensitivity to the same color of light. While the invention is typically most useful when affecting the most light sensitive layer, it can affect more than one record that is sensitive to the same color of light. For example, in a color record that is split into three layers of different relative sensitivity; fast (F), mid (M) or slow (S), the speed compound can be used in each layer only or in any combination, i.e. F+M, F+M+S, F+S, etc. in combination with the light reflecting emulsion either in or below the imaging layer. It is not necessary that these layers be adjacent; that is, they may have interlayers or even imaging layers that are sensitive to other colors located between them. The light reflecting element can be coated in any combination of the same layers, in any interlayer separating, overlying or underlying them, in proximate layers of different light color sensitivity, or in any combination thereof. In addition, although the most light sensitive layer is typically located in the film structure closest to the exposure source and farthest from the support, the invention allows for alternative locations of the layers; for example, a more light sensitive layer containing the compound useful in the invention may be located below (farther from the exposing source) than a less sensitive layer.

Moreover, when a number of layers of the same spectral sensitivity but of differing degrees of sensitivity to light are used, it is known that overall granularity can be minimized by using a smaller molar amount of dye-forming coupler than silver in the layers of higher sensitivity. Thus, it is preferred that the layers affected by the invention additionally contain less than a stoichiometric amount of total dye forming coupler(s) relative to the amount of silver contained in the same layer. A suitable molar ratio of dye-forming coupler(s) to silver in the layer containing the compound useful in the invention would be less than 0.5. Most preferred would be a ratio of 0.2 or even 0.1 or less.

It is known that film elements can contain silver halide emulsions in one layer that have maximum sensitivities that are separated or shifted from emulsions in other layers that are sensitive to the same color of light (for example, a layer containing an emulsion with maximum sensitivity at ~530 nm whereas another layer contains a different green light sensitive emulsion which is most sensitive at ~550 um) are useful for increasing the amount of interimage and improving color reproduction. The layer containing the emulsions with shifted sensitivities may not contain any image couplers at all, but rather only inhibitor releasing couplers (DIRs or DLIRs (Development Inhibitor Anchimeric Releasing couplers)) or colored masking couplers. The invention is particularly useful in this type of application since it allows for the improved color reproduction while maintaining or increasing speed of the element.

The desired effect of the invention can also be obtained when the speed compound useful in the invention is located in a non-silver containing light insensitive layer, especially one that is adjacent to an imaging layer, particularly the most sensitive layer of a multilayer record. Suitably, the light insensitive layer is an interlayer located between two light sensitive imaging layers. The interlayer can be located between two imaging layers sensitive to the same color or different. The interlayer may also contain additional materials such as oxidized developer scavengers, colored organic filter dyes, density forming couplers or photographically useful groups-releasing couplers. It is convenient for this embodiment that the speed compound be located in a non-silver containing interlayer between the blue and green sensitive color records or a non-silver containing interlayer between the green and red sensitive color records. The non-light sensitive layer containing a speed compound useful in the invention cannot additionally contain either metallic silver or any type of finely divided silver salt such as the light reflecting emulsions described above.

The elements of the invention tend to increase the Dmin of the emulsion layers they affect. Thus, it is often highly advantageous to use the elements of the invention in combination with any of the antifoggants or scavengers known in the art to be useful in controlling Dmin or fog. Specific examples of scavengers for oxidized developers would be 2,5-di-t-octylhydroquinone, 2-(3,5-bis-(2-hexyldodecylamido)benzamido)-1,4-hydroquinone, 2,4-(4-dodecyloxybenzenesulfonamido)phenol, 2,5-dihydroxy-4-(1-methylheptadecyl)benzenesulfonic acid or 2,5-di-s-dodecylhydroquinone. Specific examples of useful antifoggants are compounds AF-1 to AF-8 whose structures are shown below as well as 4-hydroxy-6-methyl-1,3,3a,7-tetraazaindene:

AF-1

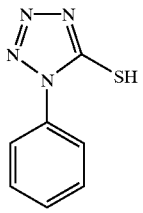

AF-2

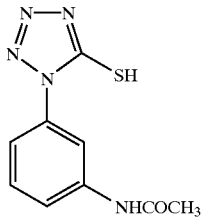

AF-3

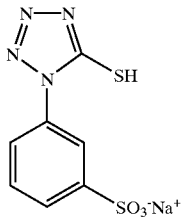

AF-4

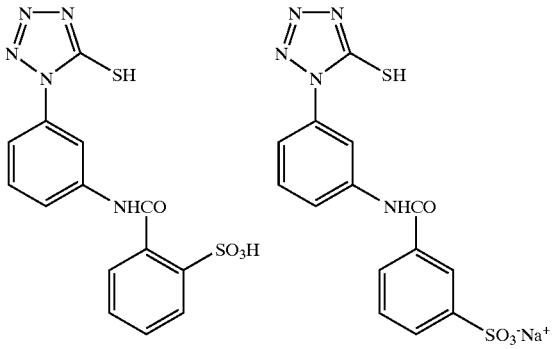

AF-5

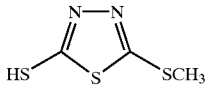

AF-6

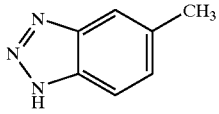

AF-7

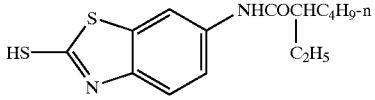

AF-8

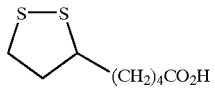

If the speed compounds useful in the invention have a suitable N—H or O—H, the hydrogen may be optionally replaced with a group that is removed in a non-imagewise fashion during the development step to regenerate the original N—H or O—H group. This offers the advantage of minimizing or avoiding undesirable interactions of the compound with the silver halide emulsion before processing. In this case, it is the C log P of the unblocked compound that is important and should be calculated with the hydrogen present and without the blocking group. Any of the temporary blocking groups known in the art to decompose in the developer in a non-imagewise manner can be used for this purpose. Particularly useful are those blocking groups that rely on some specific component of the developer solution to cause decomposition and regeneration of the original substituent. One example of this kind of blocking group, which relies on the hydroxylamine present in the developer, is described in U.S. Pat. No. 5,019,492.

The use of so-called 'electron transfer agent releasing compounds or 'ETARCs, for example as described in U.S. Pat. Nos. 4,912,025, 5,605,786, 4,859,578 and 9,224,230, together with the heterocyclic materials useful in the invention is highly beneficial. An ETARC is any compound, usually a coupler, that reacts with oxidized color developer to produce an electron transfer agent in an imagewise fashion. Some of such ETARCs release, as electron transfer agents, pyrazolidinones derived from compounds generally of the type described in U.S. Pat. Nos. 4,209,580; 4,463,081; 4,471,045; and 4,481,287 and in published Japanese patent application Serial No. 62-123,172. Such compounds comprise a 3-pyrazolidinone structure having an unsubstituted or a substituted aryl group in the 1-position. Preferably these compounds have one or more alkyl groups in the 4- or 5-positions of the pyrazolidinone ring. Typically the ETARC is a coupler that reacts imagewise with a developing agent. ETARCs useful in the invention have a C log P greater than or equal to 2.40. The ETARC may be present anywhere in the element but is preferably located in the same layer as the speed increasing heterocycle or it may be present in an adjacent layer. The amount of ETARC that can be employed with this invention can be any concentration that is effective for the intended purpose. A typical range for the compound to be employed is at a concentration from 10 $\mu$mole/m$^2$ to 500 $\mu$mole/m$^2$. A preferred concentration range is 60 $\mu$mole/m$^2$ to 125 $\mu$mole/m$^2$.

Particularly desirable are ETARCSs represented by the formula:

$$CAR—(L)_n—ETA$$

wherein CAR is a carrier moiety which is capable of releasing —(L)n-ETA on reaction with oxidized developing agent; L is a divalent linking group, n is 0, 1 or 2; and ETA is a releasable 1-aryl-3-pyrazolidinone electron transfer agent having C log P greater than or equal to 2.40 bonded to L or CAR through either the nitrogen atom in the 2-position or the oxygen attached to the 3-position of the pyrazolidinone ring. The linking group —$(L)_n$— is employed to provide for controlled release of the ETA moiety from the coupler moiety so that the effect of accelerated silver halide development can be quickly attained. L represents a divalent linking group which is both a good leaving group and allows release of the ETA without a long delay. n is 0, 1 or 2. L can include an —O—C(=O)—, O—C(=S)—, O—C(=$NR_8$)— or O—C(=$NSO_2R_{10}$)— group as the sole link between CAR and ETA or in addition to another linking group. Various types of known linking groups can be used. These include quinone methide linking groups such as are disclosed in U.S. Pat. No. 4,409,323; pyrazolonemethide linking groups such as are disclosed in U.S. Pat. No. 4,421,845; and intramolecular nucleophillic displacement type linking groups such as are disclosed in U.S. Pat. No. 4,248,962.

The ETAs with a C log P of at least 2.4 are particularly desirable for use in color photographic systems since they minimize diffusion from the layer where they are released. Wandering of the ETA fragment into adjacent color records causes improved development in those layers, thus reducing color purity and severely degrading color reproduction.

The following are examples of ETARCs suitable for use as part of this invention:

ETARC-1

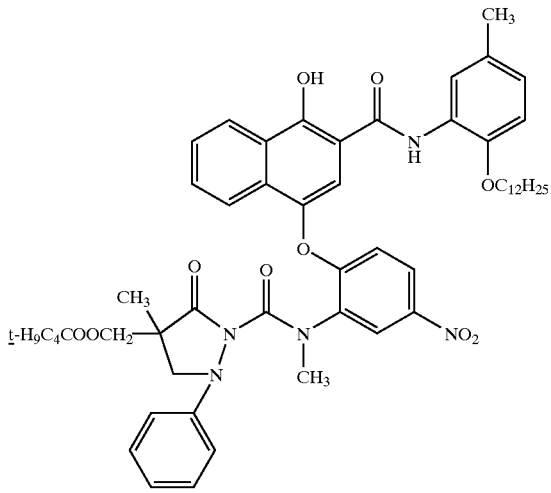

ETARC-2

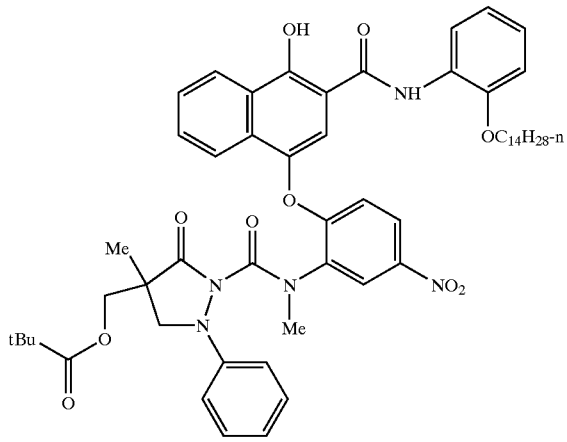

ETARC-3

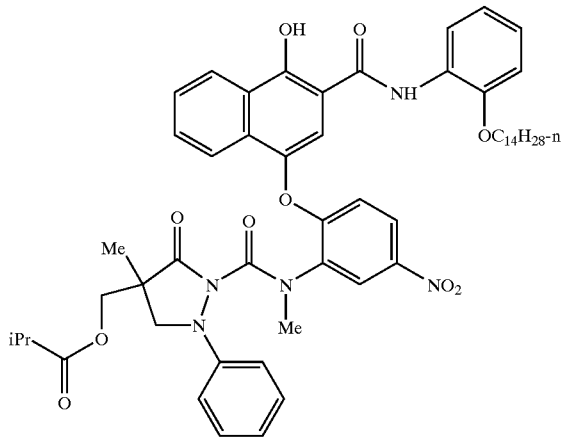

-continued
ETARC-4
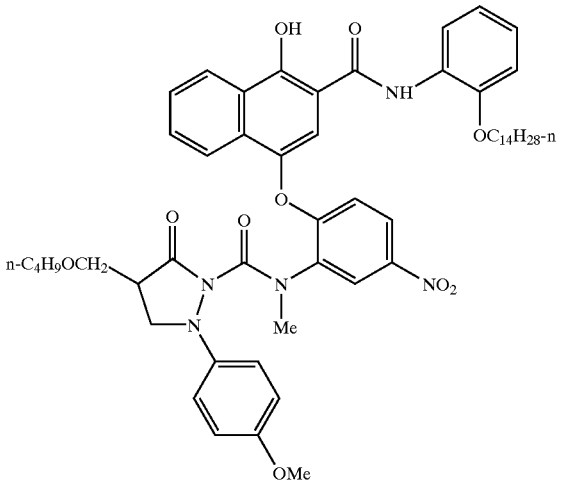
ETARC-5
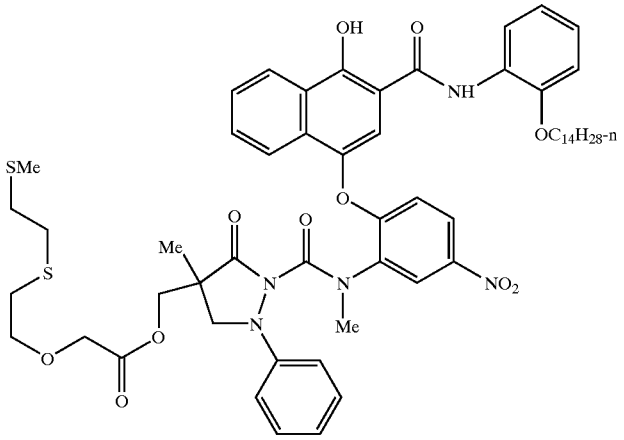
ETARC-6
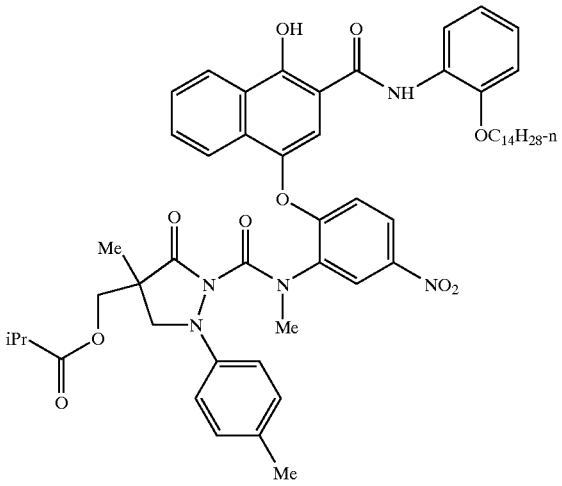

-continued
ETARC-7
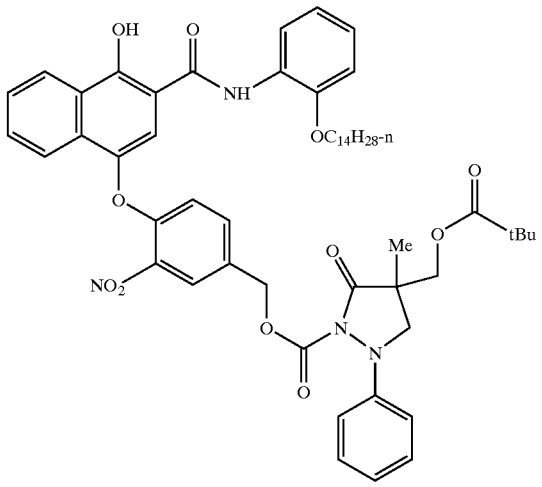
ETARC-8
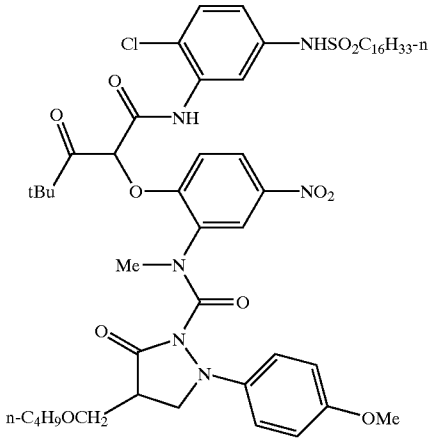
ETARC-9
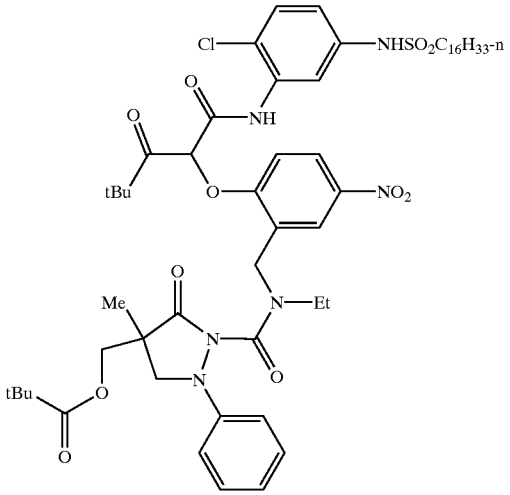

-continued

ETARC-10

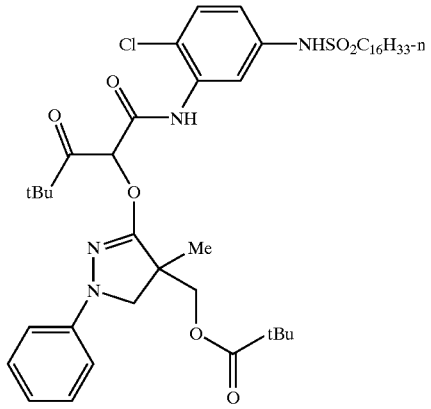

ETARC-11

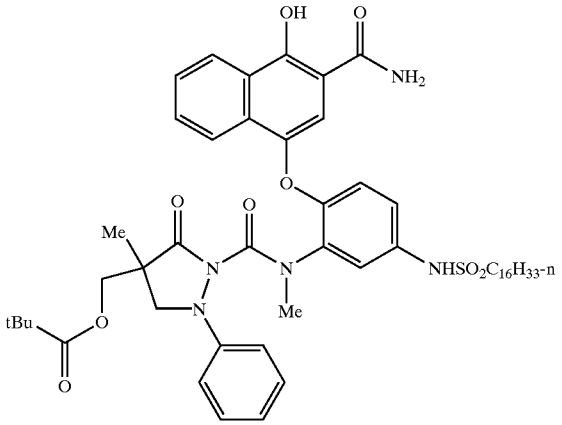

ETARC-12

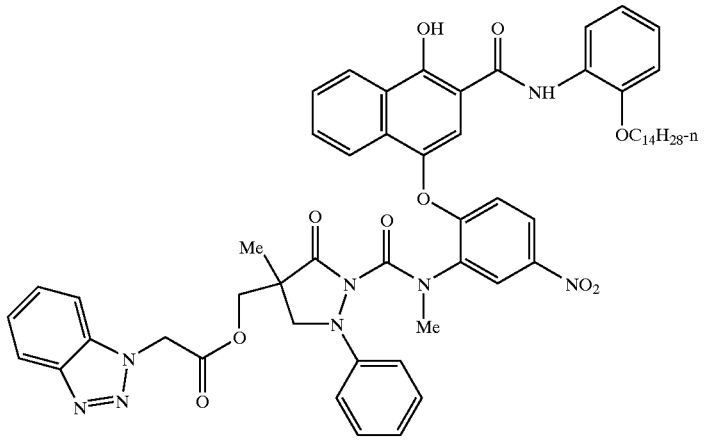

The elements of the invention may be employed in combination with light reflecting materials to further enhance the speed of the imaging layers. The light reflecting materials and film elements containing them can be, for example, any of those described in U.S. Pat. Nos. 3,989,527, 5,994,042, 5,994,043, 5,998,113, 5,998,114, 6,001,548 and 5,998,115.

Unless otherwise specifically stated or when the term "group" is used, it is intended throughout this specification, when a substituent group contains a substitutable hydrogen, it is intended to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine, iodine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)

ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)hexanamido, alpha-(4-hydroxy-3-t-butylphenoxy)tetradecanamido, 2-oxopyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbaamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

To control the migration of various components, it may be desirable to include a high molecular weight or polymeric backbone containing hydrophobic or "ballast" group in molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

As used herein, the term "color photographic element" means any element containing a light-sensitive silver halide emulsion layer containing an image dye-forming coupler. They can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. A single color element may comprise a combination of couplers in one or more common layers which upon processing together form a monocolor, including black or gray, (so-called chromogenic black and white) dye image.

A typical color photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, or subbing layers.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and reflecting materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, or color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp.126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591;

5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent No. 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIRs). DIRs useful in conjunction with the compositions useful in the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) that also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

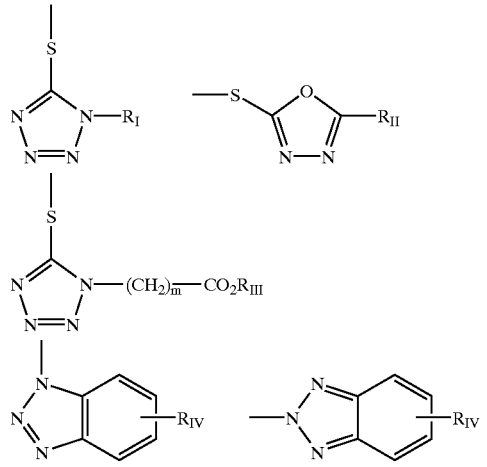

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features described above. It is typical that the timing group is of one of the formulas:

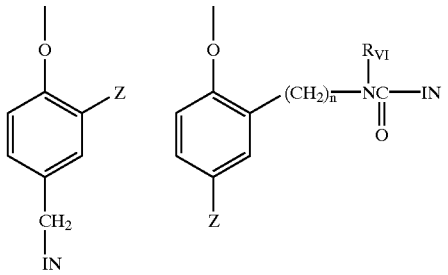

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers that may be included in photographic light sensitive emulsion layer include, but are not limited to, the following:

D1

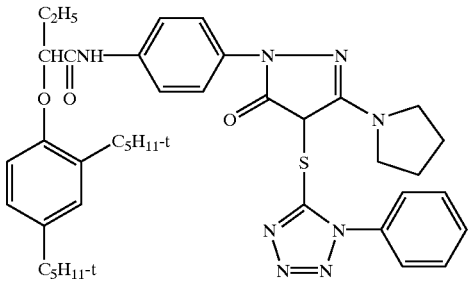

D2

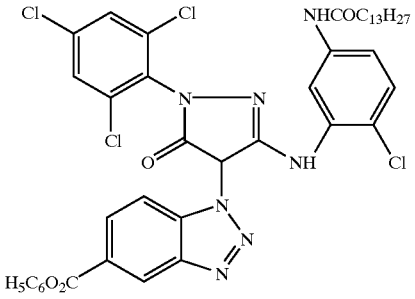

D3

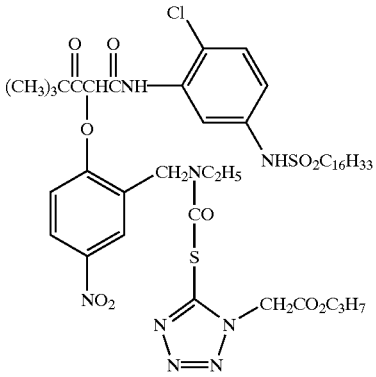

D4

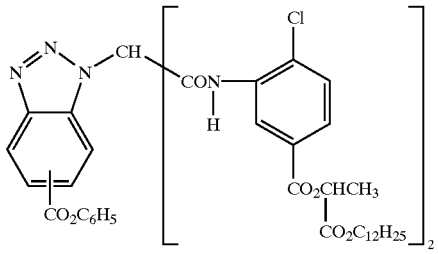

D5

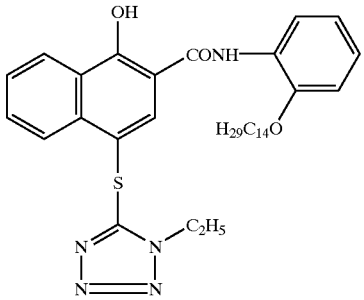

-continued

D6

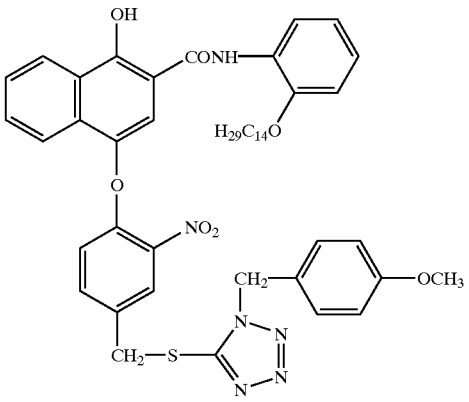

D7

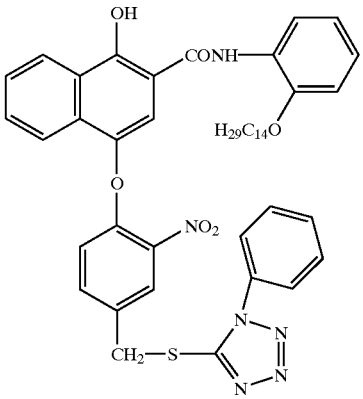

D8

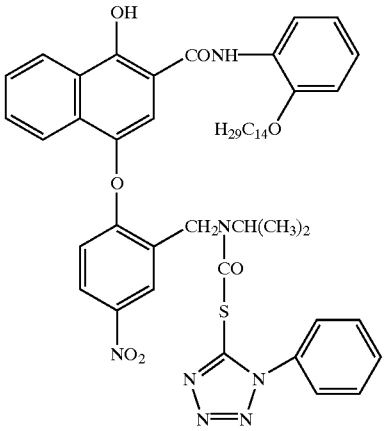

D9

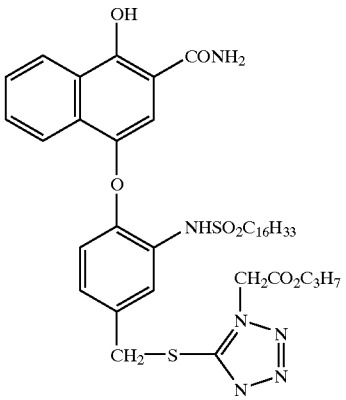

-continued

D10

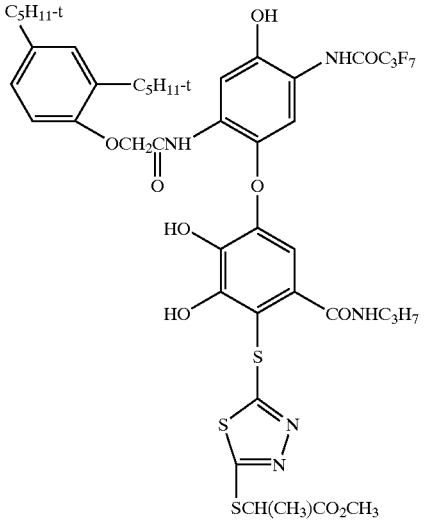

D11

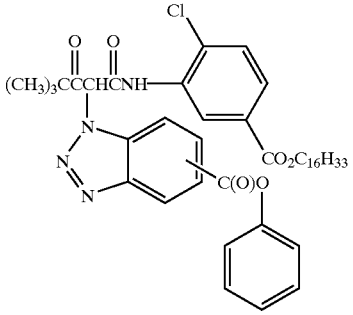

D12

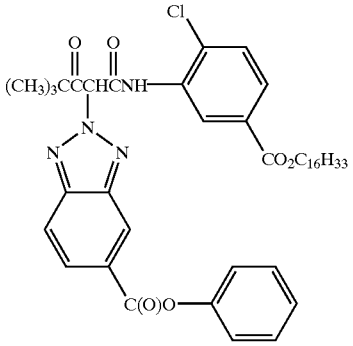

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). The major faces of the tabular grains can lie in either {111} or {100} crystal planes. Specifically contemplated tabular grain emulsions are those in which greater than 50 percent of the total projected area of the emulsion grains are accounted for by tabular grains having a thickness of less than 0.3 micrometer (0.5 micrometer for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECDs seldom exceed about 4 micrometers. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendiek et al. U.S. Pat. No. 4,672,027 reports a 3 mol percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. Tabular grain emulsions consisting predominantly of silver chloride are useful and are described, for example, in U.S. Pat. Nos. 5,310,635; 5,320,938; and 5,356,764.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, 5,147,772, 5,147,773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color-developing agent. Oxidized color-developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41™ process as described in The British Journal of Photography Annual of 1988, pages 191–198. If a color negative film element is to be subsequently employed to generate a viewable projection print as for a motion picture, a process such as the Kodak ECN-2™ process described in the H-24 Manual available from Eastman Kodak Co. may be employed to provide the color negative image on a transparent support. Color negative development times are typically 3 minutes 15 seconds. The photographic element of the invention can be incorporated into exposure structures intended for repeated use or exposure structures intended for limited use, variously referred to by names such as "single use cameras", "lens with film", or "photosensitive material package units".

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6™ process. Alternatively, a direct positive emulsion can be employed to obtain a positive image.

The above emulsions are typically sold with instructions to process using the appropriate method such as the mentioned color negative (Kodak C-41) or reversal (Kodak E-6) process.

Preferred color developing agents are p-phenylenediamines such as:

4-amino-N,N-diethylaniline hydrochloride,
4-amino-3-methyl-N,N-diethylaniline hydrochloride,
4-amino-3-methyl-N-ethyl-N-(2-methanesulfonamidoethyl) aniline sesquisulfate hydrate,
4-amino-3-methyl-N-ethyl-N-(2-hydroxyethyl)aniline sulfate,
4-amino-3-(2-methanesulfonamidoethyl)-N,N-diethylaniline hydrochloride, and
4-amino-N-ethyl-N-(2-methoxyethyl)-m-toluidine di-p-toluene sulfonic acid.

Of the above, developers based on 4-amino-3-methyl-N-ethyl-N-(2-hydroxyethyl)aniline and 4-amino-3-methyl-N-ethyl-N-(2-methanesulfonamidoethyl)aniline are especially preferred. Moreover, because the compounds useful in the invention give increased light sensitivity, they are especially useful in processes that have shortened development times. In particular, the elements of the invention can be processed with development times of less than 3.25 minutes or even less than 3 minutes or in extreme cases, even less than 120 seconds.

Development is usually followed by the conventional steps of bleaching, fixing, or bleach-fixing, to remove silver or silver halide, washing, and drying.

The entire contents of the patents and other publications referred to in this specification are incorporated herein by reference.

SYNTHESIS EXAMPLE

Synthesis of 6-(tetradecyloxy)purine (A)

Potassium tert-butoxide (284.50 g, 2.54 mol) was added to a stirred solution of tetradecanol (271.75 g, 1.27 mol) in tetrahydrofuran (5 l) under an atmosphere of nitrogen. A thick precipitate formed and the reaction became slightly warm. The reaction was stirred for 0.5 h and then 6-chloropurine (196.20 g, 1.27 mol) was added and the reaction stirred for 0.25 hr before being heated at reflux for 3 h. The reaction was allowed to cool, and then the solvent was removed in vacuo. First water (4 l) then concentrated hydrochloric acid (135 ml, 1.35 mol) was added to the residue and the suspension was stirred for 0.5 h after which time it was still acidic. The suspension was neutralized with saturated sodium hydrogen carbonate solution. After stirring vigorously for 0.5 h the solid was removed by filtration and recrystallized from methanol (about 4.5 l). A small amount of solid did not dissolve. The suspension was allowed to cool to room temperature but was not cooled further. This gave a white solid that was recrystallized once more from methanol (about 4.5 l). Again, a small amount of solid did not dissolve so it was removed whilst the methanol was still hot. This solid was insoluble in water and common organic solvents (acetone, methanol, tetrahydrofuran, ethyl acetate and dichloromethane). The suspension was allowed to cool to room temperature. Filtration and drying at oil pump vacuum (approximately 300 ml of methanol removed) gave a white solid (325.90 g).

5-Amidobenzotriazoles were prepared by acylation of commercially available 5-aminobenzotriazole using methods such as those described in JP 60-133061A2, GB 2011391 and NL 6414144. 1-(3-Amidophenyl)-5-mercaptotetrazoles were prepared by acylation of 1-(3-aminophenyl)-5-mercaptotetrazole as described in FR 1445324. 4,5-Disubstituted-1,2,3-triazoles were prepared via the procedure given in Tetrahedron, 1973.

Synthesis of ETARC-1

29(21), 3271–3283.

A schematic representation of the reactions involved in this synthesis is as follows:

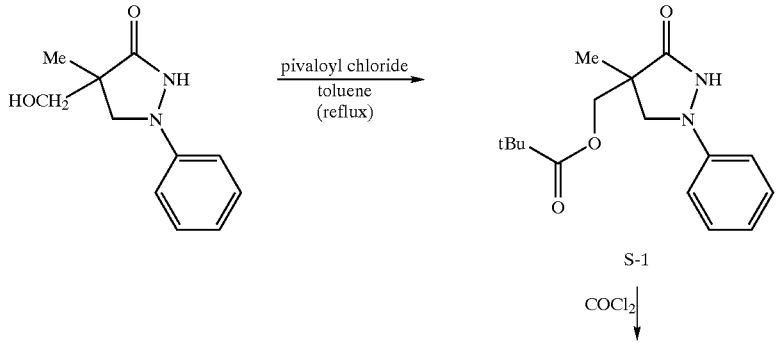

-continued

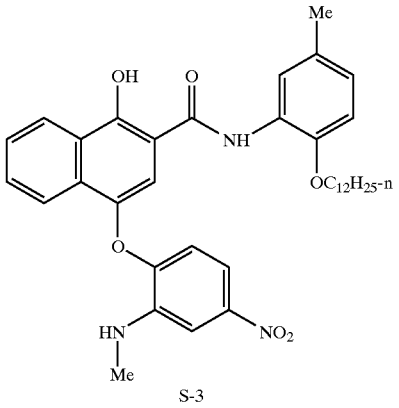

S-3

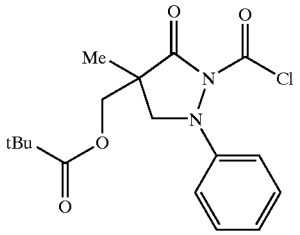

S-2

ETARC-1

Synthesis of Intermediate S-1

A 1 L 3-neck reaction flask was charged with 4-(hydroxymethyl)-4-methyl-1-phenyl-3-pyrazolidinone (Aldrich, 90%, remainder isopropanol, 20 g, 87 mmol). Toluene (220 mL) was added and the solution was warmed almost to reflux. Pivaloyl chloride (15 mL, 122 mmol) was added dropwise as a solution in toluene (20 mL). The solution was heated to reflux for 2 h. The solution was cooled to 40° C. and the toluene was removed at reduced pressure. The resulting oil was diluted with EtOAc. The organic phase was washed with water, brine and dried over $MgSO_4$. After removing the solvents, the oil was allowed to sit at reduced pressure (~1 mm Hg) for ~30 min. Absolute ethanol (50 ML) was added and then most of the ethanol was removed to give a thick oil containing a small amount of EtOH. This was allowed to sit at 25° C. overnight whereupon crystals formed. The solid was filtered and washed once with EtOH and three times with P950 ligroin. After drying, intermediate S-1 (20.3 g, 80%) was obtained as a white solid.

Synthesis of Intermediate S-2

A 2 L 3-neck flask equipped with an overhead stirrer and 500 mL addition funnel was flushed with dry nitrogen. Phosgene (1.93M in toluene, 235 mL, 451 mmol) was added followed by 600 mL $CH_2Cl_2$. The solution was cooled to −70° C. Intermediate S-1 (119 g, 410 mmol) was dissolved in $CH_2Cl_2$ (500 mL) in a 1 L Erlenmeyer flask. Diisopropylethylamine (79.0 mL, 451 mmol) was added to the solution of intermediate S-1 to form a red solution. The red solution was added to the −70° C. phosgene solution over 45 min. via the addition funnel. The reaction was maintained at −70 C. for 2 h. Concentrated HCl (10 mL) was added and the cold reaction mixture diluted with $CH_2Cl_2$ (500 mL). The cold organic layer was placed in a 2 L separatory funnel and washed with 10% HCl (2×200 mL) and brine (1×200 mL). The organic extract was dried over $MgSO_4$. After removing the $CH_2Cl_2$, the yellow oil was transferred to a 500 mL Erlenmeyer flask, rinsing with the minimum amount of warm toluene (3×15 mL). Ligroin P950 (100 mL) was added and the solution was allowed to sit at 25° C. as a white solid started to form. The flask was covered and stored at 4° C. overnight. The solids were filtered and placed under reduced pressure to give 150 g (100%) of intermediate S-2 containing a small amount of toluene.

Synthesis of Compound ETARC-1

A 2 L 3-neck flask was equipped with an overhead stirrer, a nitrogen inlet and was charged with intermediate S-3 (87 g, 138 mmol). THF (700 mL) was added followed by dimethylaniline (87 mL, 690 mmol) and the mixture was cooled to 0° C. Intermediate S-2 (59.0 g, 166 mmol) was added in one portion and the reaction was allowed to slowly warm to 25° C. After 17 h, the reaction was poured into 200 g ice plus 200 mL 3N HCl. The organic layer was extracted into EtOAc (3×200 mL), washed with 5% HCl, and brine. After drying over $MgSO_4$, the solvents were removed to give an orange foam. The crude foam was crystallized from hot n-heptane using 8 mL n-heptane per gram of crude product. After filtering and washing the resulting solid with hexanes, compound ETARC-1 (117 g, 90%) was obtained as a cream colored solid.

PHOTOGRAPHIC EXAMPLES

Multilayer films in format ML-A demonstrating the principles of this invention were produced by coating the following layers on a cellulose triacetate film support (coverage are in grams per meter squared, emulsion sizes are determined by the disc centrifuge method and are reported in Diameter×Thickness in micrometers). Antifoggants (including 4-hydroxy-6-methyl-1,3,3a,7-tetraazaindene), surfactants, coating aids, emulsion addenda, sequestrants, thickeners, lubricants, matte and tinting dyes were added to the appropriate layers as is common in the art.

Formulas for the identified compounds are provided either in the preceding lists or at the end of all of the examples.

Samples of each multilayer element were given a neutral 5500K stepped exposure and developed in a process described in *British Journal of Photography* 1982 *Annual,* pp 209 (which includes development using a p-phenylenediamine type compound). Speed or light sensitivity toward red light relative to a check position (e.g. ML-A-1) was determined by comparing the exposure at a point 0.15 density units above fog (Δ Red Toe Speed), or at a point 0.7 density units above fog (Δ Red Midscale Speed).

The visual sensation of non-uniformity in a developed photographic film, noise, is termed graininess, whereas an objective measure of noise is called granularity. Granularity of a red layer of a neutral exposure was determined by the RMS method (see *The Theory of Photographic Process,* $4^{th}$ Edition, T. H James, pp 618–628) using a 48 micron aperture at a red density of 0.85. RMS values are a measure of the standard deviation of density at various densities×1000. Lower RMS granularity values indicate improved photographic performance. The % changes in RMS Red granularity of neutral exposures were compared relative to the check. Negative Δ% RMS Red Granularity values indicate a desirable improvement in photographic performance. A 6% change in RMS Granularity offers a noticeable improvement in graininess as described by D. Zwick and D. Brothers, (*J. Soc. Mot. Pict. Telev. Eng.,* v86, p427–430, 1977).

Example 1

Sample ML-A-1

Layer 1 (Protective Overcoat Layer): Pol-1 at 0.108 as matte with gelatin at 0.888.

Layer 2 (UV Filter Layer): silver bromide Lippmann emulsion at 0.215, UV-1 and UV-2 both at 0.108 and gelatin at 0.700.

Layer 3 (Fast Yellow Layer): a blend of two blue sensitized silver iodobromide emulsions: (i) a large tabular emulsion (BSD-1 and BSD-2), 3.72×0.131 μm, 3.7 mole % I at 0.140 and (ii) a 3-D emulsion. 1.21 μm diameter (BSD-1), 9.7 mole % I at 1.055, Y-1 at 0.312, IR-1 at 0.065, SMARC-1 at 0.009, RA-1 at 0.009, and gelatin at 1.313.

Layer 4 (Slow Yellow Layer): a blend of three blue (BSD-1+BSD-2) sensitized tabular silver iodobromide emulsions: (i) 2.41×0.1 μm, 2.0 mole % I at 0.392, (ii) 1.02×0.137 μm, 2.0 mole % I at 0.150 and (iii) 0.62×0.111 μm, 2.6 mole % I at 0.521, yellow dye forming coupler Y-1 at 0.850, IR-1 at 0.038, IR-6 at 0.022, SMARC-1 at 0.009 and gelatin at 1.905.

Layer 5 (Top Interlayer): O×DS-1 at 0.182 and gelatin at 0.700.

Layer 6 (Fast Magenta Layer): a green sensitized (with a mixture of GSD-1 and GSD-2) silver iodobromide tabular emulsions (2.90×0.13 μm, 3.7 mole % iodide) at 1.24, magenta dye forming coupler M-1 at 0.104, masking Coupler MM-1 at 0.022, IR-7 at 0.003, IR-2 at 0.011, O×DS-1 at 0.014 and gelatin at 1.434.

Layer 7 (Mid Magenta Layer): a blend of two green sensitized (both with a mixture of GSD-1 and GSD-2) silver iodobromide tabular emulsions: (i) 2.46×0.13 μm, 3.7 mole % iodide at 0.534 and (ii) 1.45×0.13 μm, 3.7 mole % iodide at 0.420, magenta dye forming coupler M-1 at 0.104, Masking Coupler MM-1 at 0.086, IR-2 at 0.025, O×DS-1 at 0 014 and gelatin at 1.453.

Layer 8 (Slow magenta layer): a blend of two green sensitized (both with a mixture of GSD-1 and GSD-2) silver iodobromide tabular emulsions: (i) 1.17×0.12 μm, 4.5 mole % iodide at 0.156 and (ii) 0.62×0.111 μm, 2.6 mole % iodide at 0.573, magenta dye forming coupler M-1 at 0.349, Masking Coupler MM-1 at 0.093, IR-2 at 0.032, O×DS-1 at 0.011 and gelatin at 1.40.

Layer 9 (Mid Interlayer): O×DS-1 at 0.075 and gelatin at 0.538.

Layer 10 (Ultra Cyan layer): a red-sensitized (with a mixture of RSD-3, RSD-7, and RSD-4) silver iodobromide tabular emulsion (3.87×0.13 μm, 3.7 mole % I) at 1.30, cyan dye-forming coupler C-2 at 0.183, IR-4 at 0.060, IR-3 at 0.022, O×DS-1 at 0.014 and gelatin at 1.7765.

Layer 11 (Fast Cyan Layer): a red-sensitized (all with a mixture of RSD-3, RSD-7, and RSD-4) silver iodobromide tabular emulsion (2.41×0.13 μm, 3.7 mole % I) at 1.286, cyan dye-forming coupler C-1 at 0.193, IR-5 at 0.054, Soluble Mercaptide Agent Releasing Coupler SMARC-1 at 0.008 and gelatin at 1.13.

Layer 12 (Mid Cyan Layer): a red-sensitized (with a mixture of RSD-3 and RSD-7) silver iodobromide tabular emulsion (1.44×0.13 μm, 3.7 mole % I) at 0.572, cyan dye-forming coupler C-1 at 0.198, C-2 at 0.103, IR-5 at 0.043, masking coupler CM-1 at 0.022, SMARC-1 at 0.011 and gelatin at 1.00.

Layer 13 (Slow Cyan Layer): a blend of two red sensitized (both with a mixture of RSD-3 and RSD-7) silver iodobromide emulsions: (i) a large sized iodobromide tabular grain emulsion (0.81×0.11 μm, 4.5 mole % 1) at 0.371, (ii) a smaller iodobromide tabular emulsion (.0.62×0.111 μm, 4.1 mole % iodide) at 0.189, cyan dye-forming coupler C-1 at 0.236, C-2 at 0.236, IR-6 at 0.032, Soluble Mercaptide Agent Releasing Coupler SMARC-1 at 0.086, O×DS-2 at 0.052, and gelatin at 1.51.

Layer 14 (Bottom Interlayer): O×DS-1 at 0.086 and gelatin at 0.538.

Layer 15 (Antihalation layer): Black Colloidal Silver at 0.135, UV-1 and UV-2 both at 0.075 and gelatin at 1.615.

Hardener: (Bisvinylsulfonyl)methane at 1.55% of total gelatin weight.

Sample ML-A-2

Like sample ML-A-1 except in Layer 10 (Ultra Cyan Layer): cyan dye-forming coupler C-2 was omitted and replaced with C-1 at 0.075 and electron transfer agent releasing coupler ETARC-1 at 0.101.

Sample ML-A-3

Like sample ML-A-2 except in Layer 9 (Mid Interlayer): speed compound X at 0.043 was added.

Sample ML-A-4

Like sample ML-A-2 except in Layer 10 (Ultra Cyan Layer): speed compound X at 0.022 was added.

Sample ML-A-5

Like sample ML-A-1 except in Layer 10 (Ultra Cyan Layer): cyan dye-forming coupler C-2 was omitted and replaced with C-1 at 0.075 and electron transfer agent releasing coupler CETARC-1 at 0.0925 (equimolar to ETARC-1 in ML-E-2)

Sample ML-A-6

Like sample ML-A-5 except in Layer 9 (Mid Interlayer): speed compound X at 0.043 was added.

Results from testing of multilayers ML-A-1 through 6 (exposed and processed as previously described) are shown below in Table I.

TABLE I

ML-A Results

| Sample | Comparison or Invention | Layer 10 | Layer 9 | Red Speed* | Green Speed* |
|---|---|---|---|---|---|
| ML-A-1 | Comp | C-2 | — | 100 | 100 |
| ML-A-2 | Comp | C-1 + ETARC-1 | — | 105 | 100 |
| ML-A-3 | Inv | C-1 + ETARC-1 | X | 114 | 101 |
| ML-A-4 | Inv | C-1 + ETARC-1 | — | 114 | 101 |
| ML-A-5 | Comp | C-1 + CETARC-1 | — | 117 | 109 |
| ML-A-6 | Comp | C-1 + CETARC-1 | X | 124 | 106 |

*Δ Red Toe Speed or Δ Green Toe Speed calculated as previously described

The results in Table I from multilayer format ML-A show that addition of the speed heterocycle X either to the Ultra Cyan imaging layer 10 or the mid interlayer Layer 9 increased the photographic sensitivity (speed) to red light in the presence of ETARC-1 (C log P of ETA fragment=2.9).

In the presence of an ETARC which releases an ETA with C log P of less than 2.4 (CETARC-1 with C log P of ETA fragment=0.8), light sensitivity of the green layer was increased as well as the red speed, demonstrating that the ETA was diffusing from the red record into the green record. This is highly undesirable for maintaining accurate color reproduction.

Chemical Structures

CSC-1

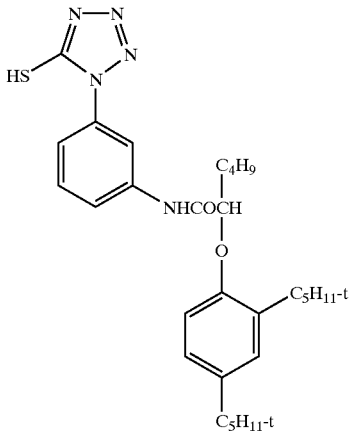

BSD-1

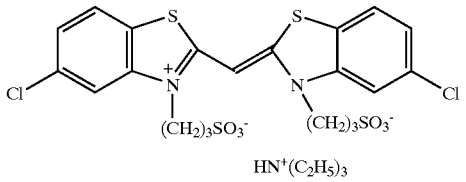

BSD-2

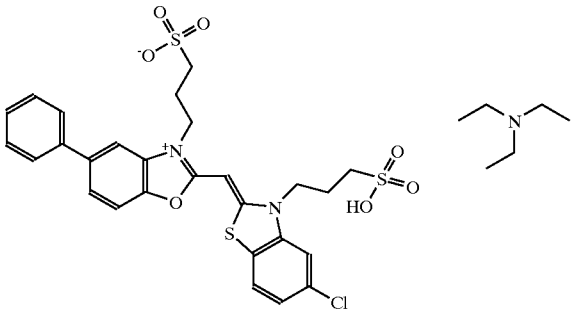

CETARC-1

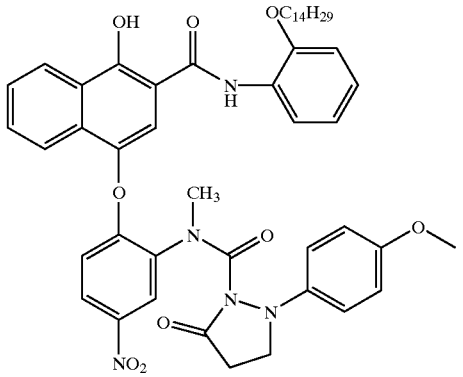

-continued

CM-1

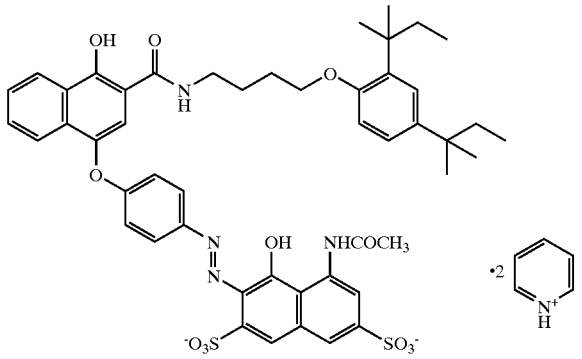

ETARC-1

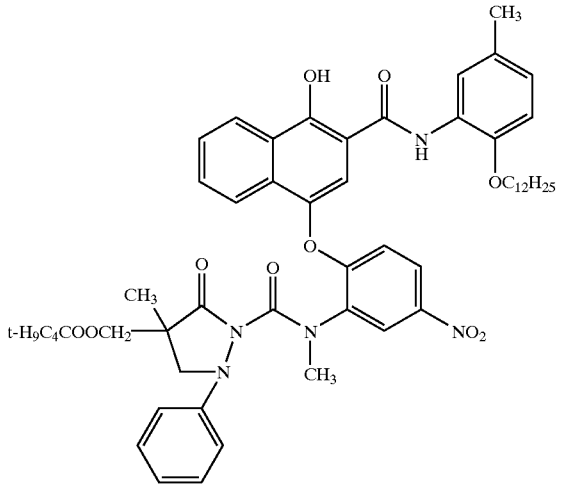

IR-1

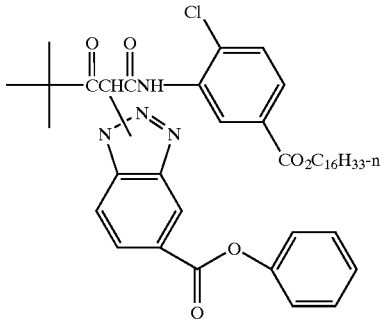

IR-2

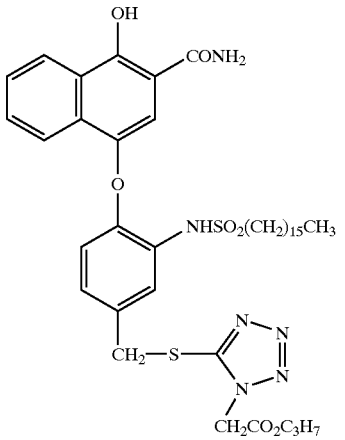

-continued
IR-3
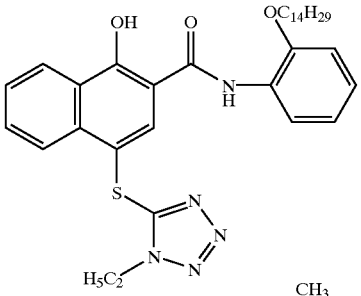
IR-4
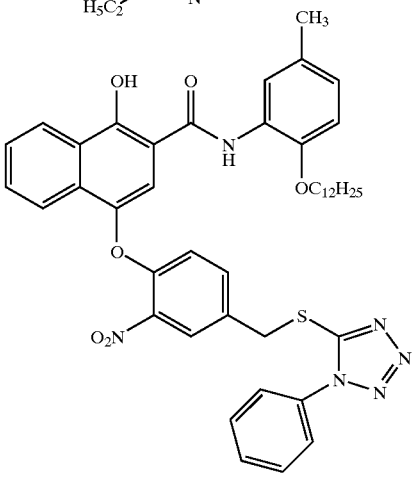
IR-5
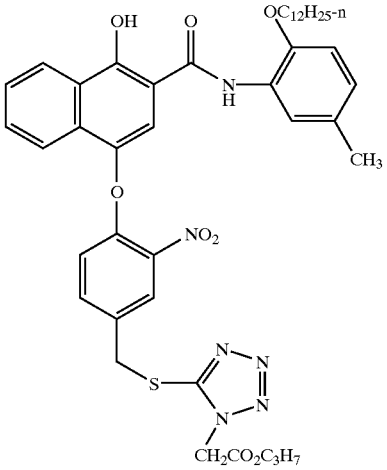
IR-6
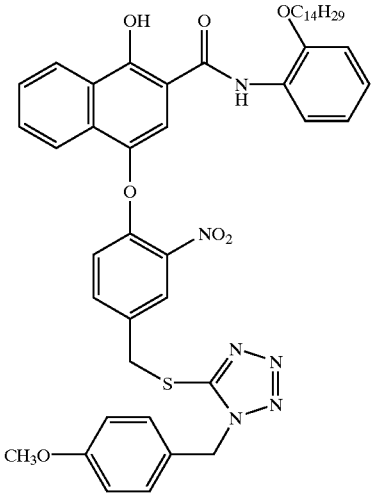
-continued
IR-7
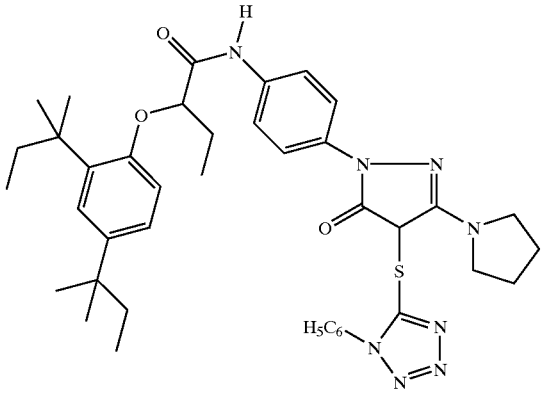
IR-8
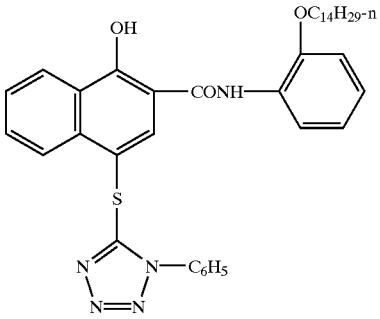
MM-1
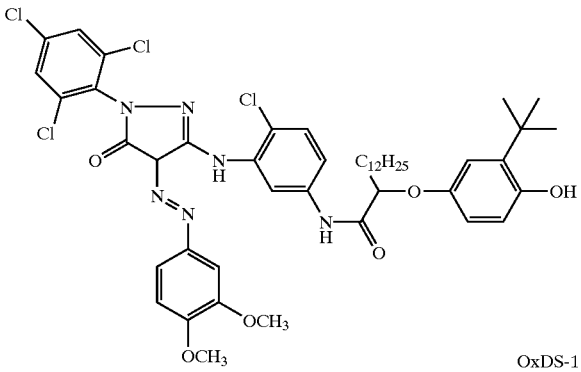
OxDS-1
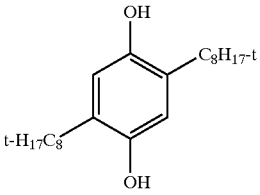
OxDS-2
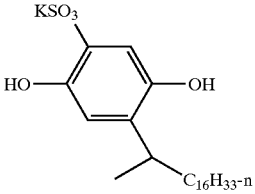
POL-1
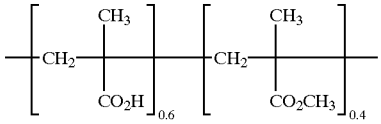

-continued

RA-1

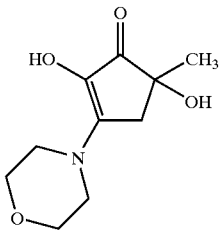

SMARC-1

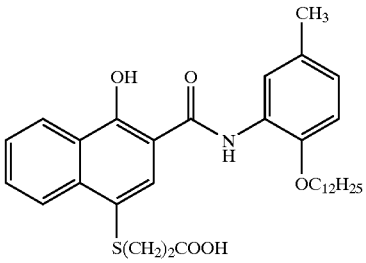

UV-1

$(CN)_2—C═CH—CH═CH—N—(C_6H_{13})_2$

UV-2

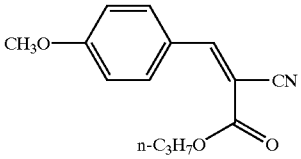

Y-1

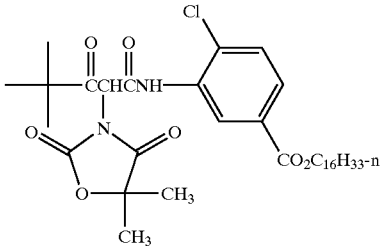

The invention has been described in detail with particular reference to preferred embodiments thereof, but it will be understood that variations and modifications can be effected within the scope and spirit of the invention.

What is claimed is:

1. A color silver halide photographic element comprising a support bearing:

(1) a light sensitive silver halide emulsion layer;

(2) a nitrogen heterocycle with a minimum of three heteroatoms that does not react with oxidized developer, does not contain free thiol substituents, and has a C log P sufficient to increase the photographic speed of said element compared to the same element without the compound, said heterocycle compound located either in said light sensitive layer or in a non-silver containing light insensitive layer adjacent to it; and (3) an electron transfer agent releasing compound (ETARC), in or adjacent to said light sensitive silver halide emulsion layer, that releases, upon reaction with oxidized developer, an electron transfer agent having a C log P of at least 2.40.

2. The element of claim 1 wherein said light sensitive silver halide emulsion layer is sensitive to green light.

3. The element of claim 1 wherein the light sensitive silver halide emulsion layer is sensitive to red light.

4. The element of claim 1 wherein the heterocycle compound is a tetraazaindene with a C log P of at least 6.2.

5. The element of claim 1 wherein the heterocycle compound is a 1,3,4,6-tetraazaindene (purine) with a C log P of at least 6.2.

6. The element of claim 5 wherein the 1,3,4,6-tetraazaindene is represented by the Formula I:

I

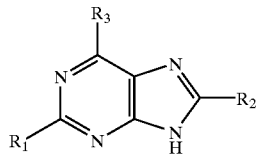

wherein $R_1$ and $R_2$ are each independently hydrogen or an alkyl, aryl, alkoxy, aryloxy, alkylthio, arylthio, sulfoxyl, sulfonyl, sulfamoyl, fluoro, chloro, bromo, iodo, cyano, nitro, —O—CO—, —O—$SO_2$—, heterocyclic, carbonyl, amino, carbonamido, or sulfonamido group and $R_3$ is an alkyl, aryl, alkoxy, aryloxy, alkylthio, arylthio, secondary or tertiary amino, carbonamido, sulfonyl or sulfonamido group.

7. The element of claim 6 wherein $R_3$ is an alkoxy or alkylthio group.

8. The element of claim 1 wherein the heterocycle compound is a benzotriazole with a C log P of at least 7.8.

9. The element of claim 1 wherein the heterocycle compound is a triazole with C log P of at least 8.75.

10. The element of claim 1 wherein the heterocycle compound is a tetrazole with a C log P of at least 6.5.

11. The element of claim 1 wherein the heterocycle compound is selected from an oxa- or thia-diazole with a C log P of at least 7.6.

12. The element of claim 1 in which the heterocycle compound is present in an amount sufficient to increase the speed of a neutral exposure by at least 0.1 of a stop compared to the same element without the compound.

13. The element of claim 1 wherein the ratio of number of millimoles of the heterocyclic compound to the number of moles of silver in the same layer is greater than 1.0.

14. The element of claim 1 in which the heterocycle compound is present at a laydown of $3.0\times10^{-5}$ mol/$m^2$ or greater.

15. The element of claim 1 wherein the nitrogen heterocycle compound is selected from the group consisting of:

A

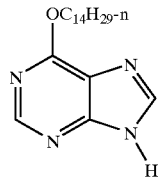

X

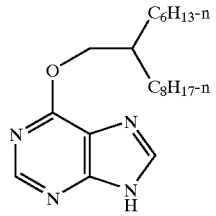

-continued

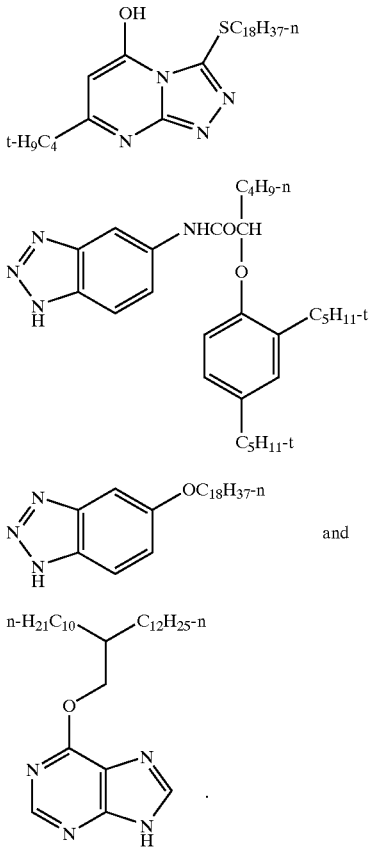

and

16. The element of claim 1 wherein the electron transfer agent is a 1-aryl-3-pyrazolidinone.

AK 17. The element of claim 1 wherein the electron transfer agent releasing compound is represented by the formula:

$$CAR—(L)_n—ETA$$

wherein:

CAR is a carrier moiety which is capable of releasing —(L)n-ETA upon reaction with oxidized developing agent;

BD L is a divalent linking group;

n is 0, 1 or 2; and

ETA is a releasable 1-aryl-3-pyrazolidinone electron transfer agent having a C log P or at least 2.40 bonded to L or CAR through either the nitrogen atom in the 2-position or the oxygen attached to the 3-position of the pyrazolidinone ring.

18. The element of claim 17 wherein L comprises a quinone methide, pyrazolonemethide or intramolecular nucleophillic displacement linking group or includes an —O—C(=O)—, O—C(=S)—, O—C(=$NR_8$)— or O—C(=$NSO_2R_{10}$)— group as the sole link between CAR and ETA or in addition to another linking group, wherein $R_8$ and $R_{10}$ are H or substituents.

BG 19. The element of claim 1 wherein the element is an origination material for capturing an original image.

20. A process for forming an image in the element of claim 1 after imagewise exposure to light comprising contacting the element with a color developing agent.

BL 21. The element of claim 1 wherein the nitrogen heterocycle is present in a light sensitive layer.

22. The element of claim 1 wherein the nitrogen heterocycle is present in a non-silver containing light insensitive layer adjacent to a light sensitive layer.

23. The element of claim 22 wherein the non-silver containing light insensitive layer is adjacent to the most light sensitive layer of a color record.

* * * * *